US008776449B1

(12) United States Patent
Rowan

(10) Patent No.: US 8,776,449 B1
(45) Date of Patent: Jul. 15, 2014

(54) SHELTER BUILDING

(71) Applicant: Marian Gilmore Rowan, Tega Cay, SC (US)

(72) Inventor: Marian Gilmore Rowan, Tega Cay, SC (US)

( * ) Notice: Subject to any disclaimer, the term of this patent is extended or adjusted under 35 U.S.C. 154(b) by 0 days.

(21) Appl. No.: 14/046,205

(22) Filed: Oct. 4, 2013

Related U.S. Application Data

(63) Continuation-in-part of application No. 13/037,237, filed on Feb. 28, 2011, now Pat. No. 8,561,358.

(60) Provisional application No. 61/338,981, filed on Feb. 26, 2010.

(51) Int. Cl.

| | |
|---|---|
| ***E04H 1/00*** | (2006.01) |
| ***E04H 14/00*** | (2006.01) |
| ***E04B 1/343*** | (2006.01) |
| ***E04H 1/12*** | (2006.01) |

(52) U.S. Cl.
CPC *E04B 1/343* (2013.01); *E04H 1/12* (2013.01); *E04B 1/34384* (2013.01)
USPC ..... 52/79.1

(58) Field of Classification Search
CPC . E04B 1/34315; E04B 1/34384; E04B 1/343; E04B 1/34321; E04B 7/022; E04B 2001/343; E04B 2001/34289; E04H 1/12; E04H 1/1205; E04H 1/1277
USPC ..... 52/79.1, 79.5, 3, 4, 5, 202, 203
See application file for complete search history.

(56) References Cited

U.S. PATENT DOCUMENTS

| | | | | | |
|---|---|---|---|---|---|
| 1,018,987 | A | * | 2/1912 | Philpot et al. | 52/177 |
| 2,255,511 | A | * | 9/1941 | Muller | 52/206 |
| 2,388,297 | A | * | 11/1945 | Slaughter | 428/53 |
| 3,018,859 | A | * | 1/1962 | Struben | 52/479 |
| 3,054,481 | A | * | 9/1962 | Johnson et al. | 52/91.1 |
| 3,069,224 | A | * | 12/1962 | Bigelow, Jr. | 52/11 |
| 3,234,700 | A | * | 2/1966 | Creveling | 52/284 |
| 3,477,184 | A | * | 11/1969 | Siivola et al. | 52/105 |
| 3,563,582 | A | * | 2/1971 | Shroyer et al. | 52/309.13 |
| 3,815,308 | A | * | 6/1974 | Corey | 52/316 |
| 4,034,527 | A | * | 7/1977 | Jalasjaa | 52/233 |

(Continued)

FOREIGN PATENT DOCUMENTS

JP 03090765 A * 4/1991

*Primary Examiner* — Mark Wendell
*Assistant Examiner* — Keith Minter

(57) ABSTRACT

Housing for emergencies or for those in need could be a short-term solution or may be set up as a longer-term shelter. The shelter may be flexible to grow and change enough to accommodate the individual, the family and the community. The shelter is more substantial than a tent and easier to assemble and transport as compared to conventional shelters. The smaller of shelters can be transported in a standard size truck bed (for example, 8 feet by 12 feet) and erected by two individuals in a minimal amount of time, typically less than an hour. The shelter may include various features, including shelving, bathing facilities, sinks, beds, lighting, and the like. The design of the shelter is to be connected to external electric and water supplies. Optionally, the shelters may be designed as stand-alone, "off-the-grid" units. The ceiling of the shelter may include one or more solar panels to provide power for the shelter. The shelter's container provides the essentials needed to sustain life. This takes away the need for standing in multiple lines and gives the much-needed immediate help.

20 Claims, 36 Drawing Sheets

(56) References Cited

U.S. PATENT DOCUMENTS 4,599,841 A * 7/1986 Haid ..... 52/396.04
4,805,357 A * 2/1989 Aleixo ..... 52/79.1
5,036,634 A * 8/1991 Lessard et al. ..... 52/79.1
5,377,470 A * 1/1995 Hebinck ..... 52/405.1
5,694,730 A * 12/1997 Del Rincon et al. ..... 52/586.1
D421,133 S * 2/2000 Mandell ..... D25/61
6,192,641 B1 * 2/2001 Andraso et al. ..... 52/396.01
6,250,022 B1 * 6/2001 Paz et al. ..... 52/79.5
6,550,216 B1 * 4/2003 Ohanesian ..... 52/783.11
6,604,328 B1 * 8/2003 Paddock ..... 52/93.1
6,843,025 B2 * 1/2005 Paz ..... 52/79.1
6,865,855 B2 * 3/2005 Knauseder ..... 52/592.1
7,155,865 B2 * 1/2007 Rosenberg ..... 52/79.9
7,377,081 B2 * 5/2008 Ruhdorfer ..... 52/588.1
7,509,776 B2 * 3/2009 Reisman ..... 52/281
7,581,357 B2 * 9/2009 Richardson et al. ..... 52/79.5
7,600,348 B1 * 10/2009 Kostka ..... 52/63
7,614,199 B2 * 11/2009 Smalley, III ..... 52/741.13
7,770,334 B2 * 8/2010 Mower et al. ..... 52/32
7,779,579 B2 * 8/2010 Mower et al. ..... 52/79.1
7,877,936 B2 * 2/2011 Uffner et al. ..... 52/90.1
7,926,227 B2 * 4/2011 Mower et al. ..... 52/79.6
8,001,731 B2 * 8/2011 Huxel ..... 52/79.9
8,001,740 B2 * 8/2011 Smith et al. ..... 52/483.1
8,020,347 B2 * 9/2011 Mower et al. ..... 52/79.1
8,051,617 B2 * 11/2011 Mower et al. ..... 52/311.1
8,065,846 B2 * 11/2011 McDonald et al. ..... 52/281
8,091,157 B2 * 1/2012 Tyler et al. ..... 4/477
8,096,083 B2 * 1/2012 Ma et al. ..... 52/36.2
8,132,372 B2 * 3/2012 Mower et al. ..... 52/79.1
8,151,539 B2 * 4/2012 Grinsted ..... 52/745.1
8,186,110 B2 * 5/2012 Green ..... 52/79.9
2001/0039768 A1 * 11/2001 Bigelow ..... 52/79.1
2004/0074158 A1 * 4/2004 De Zen ..... 52/79.9
2004/0101357 A1 * 5/2004 Dijkstra et al. ..... 403/403
2004/0134135 A1 * 7/2004 Zich et al. ..... 52/36.1
2004/0187400 A1 * 9/2004 Anderson et al. ..... 52/79.1
2004/0255526 A1 * 12/2004 Tremblay ..... 52/79.5
2005/0066587 A1 * 3/2005 Brisson ..... 52/79.1
2005/0210761 A1 * 9/2005 Mower et al. ..... 52/64
2005/0223652 A1 * 10/2005 Mower et al. ..... 52/79.1
2006/0048459 A1 * 3/2006 Moore ..... 52/79.1
2006/0059792 A1 * 3/2006 Tiramani ..... 52/79.1
2006/0185262 A1 * 8/2006 Abler ..... 52/64
2006/0185264 A1 * 8/2006 Donahue et al. ..... 52/79.1
2006/0191209 A1 * 8/2006 Reisman ..... 52/36.2
2006/0230704 A1 * 10/2006 Lambreth ..... 52/745.02
2007/0044391 A1 * 3/2007 Richardson et al. ..... 52/79.1
2007/0175108 A1 * 8/2007 Stein et al. ..... 52/79.5
2007/0245676 A1 * 10/2007 Jaks et al. ..... 52/639
2008/0047217 A1 * 2/2008 Browning et al. ..... 52/588.1
2008/0110484 A1 * 5/2008 Doran ..... 135/121
2008/0216426 A1 * 9/2008 Bunker ..... 52/285.3
2008/0263968 A1 * 10/2008 Day ..... 52/79.1
2009/0032530 A1 * 2/2009 Chu ..... 220/4.28
2009/0107077 A1 * 4/2009 Zhang ..... 52/588.1
2009/0193751 A1 * 8/2009 Auerbach ..... 52/741.1
2009/0223161 A1 * 9/2009 Segall ..... 52/588.1
2010/0031585 A1 * 2/2010 Saito ..... 52/79.1
2010/0205871 A1 * 8/2010 Mower et al. ..... 52/79.12
2010/0293868 A1 * 11/2010 Holzworth ..... 52/79.5
2010/0325971 A1 * 12/2010 Leahy ..... 52/79.1
2011/0011010 A1 * 1/2011 Mower et al. ..... 52/79.5
2011/0041415 A1 * 2/2011 Esposito ..... 52/12
2011/0107690 A1 * 5/2011 Ralston ..... 52/79.1
2011/0173898 A1 * 7/2011 Denicourt et al. ..... 52/79.1
2011/0179722 A1 * 7/2011 Schulz et al. ..... 52/79.1
2011/0185644 A1 * 8/2011 Hutter ..... 52/79.1
2011/0202396 A1 * 8/2011 Viveiros et al. ..... 705/14.4
2011/0203189 A1 * 8/2011 Moran ..... 52/2.18
2011/0258943 A1 * 10/2011 De Zen et al. ..... 52/43
2011/0289860 A1 * 12/2011 Wilson ..... 52/79.5
2012/0000142 A1 * 1/2012 McKimmy et al. ..... 52/79.1
2012/0005969 A1 * 1/2012 Broden ..... 52/79.9
2012/0017519 A1 * 1/2012 Peck ..... 52/79.1
2012/0102847 A1 * 5/2012 Kopp et al. ..... 52/79.1
2012/0110925 A1 * 5/2012 Weber ..... 52/79.1
2012/0110926 A1 * 5/2012 Phillips et al. ..... 52/79.9
2012/0311940 A1 * 12/2012 Medley ..... 52/79.5
2013/0000218 A1 * 1/2013 Uffner et al. ..... 52/79.1
2013/0014450 A1 * 1/2013 Esposito ..... 52/11
2013/0074424 A1 * 3/2013 Trascher et al. ..... 52/79.5
2013/0086849 A1 * 4/2013 Clouser et al. ..... 52/79.9
2013/0091783 A1 * 4/2013 Reinmann et al. ..... 52/79.5
2013/0091796 A1 * 4/2013 Thomas et al. ..... 52/506.01
2013/0152485 A1 * 6/2013 Austin et al. ..... 52/79.8
2013/0192147 A1 * 8/2013 Schaffert ..... 52/79.5

* cited by examiner

SHELTER BUILDING

CROSS-REFERENCE TO RELATED APPLICATIONS

The present invention claims the benefit of U.S. Provisional application No. 61/338,981, filed Feb. 26, 2011, which is herein incorporated by reference. The present application is a continuation-in-part of U.S. Ser. No. 13/037,237 filed Feb. 28, 2011, now U.S. Pat. No. 8,561,358 entitled "SHELTER BUILDING", the disclosure of which is expressly incorporated herein by reference.

STATEMENT REGARDING FEDERALLY SPONSORED RESEARCH OR DEVELOPMENT

"Not Applicable"

THE NAMES OF THE PARTIES TO A JOINT RESEARCH AGREEMENT

"Not Applicable"

INCORPORATION-BY-REFERENCE OF MATERIAL SUBMITTED ON A COMPACT DISC

"Not Applicable

The present invention relates to shelter buildings, more particularly, to a shelter that may be easily transported, readily assembled and its container provides the essentials to sustain life. The present invention can be assembled without tools nor hardware, and will emergency eliminate waiting in multiple lines for Shelter and Provisions.

During situations, shelters, supplies and other items are often needed for people. Conventional shelters may be difficult to transport, difficult to set-up and may be limited in its size, shape and features. Following a natural disaster, such as an earthquake, hurricane, tornado, or the like, people may need shelter during the period that they are rebuilding their homes. In these situations, the shelter is needed quickly and should be easy to assemble, where a family may be able to create the shelter on their own. During emergencies, at present, there are no containers that provide all of the following: food, supplies, shelter and the essentials needed to sustain life. Typical shelters may require professional installation or may be too costly to supply thousands of living quarters. Simple shelters, such as tents, may not suitable for long periods of time or may not stand up to weather conditions.

As can be seen, there is a need for a shelter that may be easily transported and readily assembled. Furthermore this invention will enable people with low income to have a home of their own.

SUMMARY OF THE INVENTION

In one aspect of the present invention, a shelter comprises a floor formed of one or more floor members, the floor members adapted to connect to each other with female slot and corresponding male fittings; a plurality of wall members adapted to connect to each other with slots and corresponding male fittings, the floor adapted to connect to the wall members with female slot and corresponding male fittings; a ceiling formed of one or more ceiling members, the ceiling members adapted to connect to each other with slots and corresponding male fittings, the ceiling members further adapted to connect to the wall members with female slot and corresponding male fittings.

In another aspect of the present invention, a shelter kit comprises a container providing essential supplies and having one or more floor members adapted to form a floor, the floor members adapted to connect to each other with slots and corresponding male fittings; a plurality of wall members adapted to connect to each other with slots and male fittings, the floor adapted to connect to the wall members with slots and corresponding male fittings; one or more ceiling members adapted to form a ceiling, the ceiling members adapted to connect to each other with slots and male fittings, the ceiling members further adapted to connect to the wall members with slots and corresponding male fittings; one of more ladders for assembling a shelter from the shelter kit components and emergency provisions.

These and other features, aspects and advantages of the present invention will become better understood with reference to the following drawings, description and claims.

BRIEF DESCRIPTION OF THE DRAWINGS

For clarity let it be known that the following words are used interchangeably.

1. Beam/Male connector/fitting/clip (that corresponds to the females slot)
2. Sections (make up a)/Member/panel (with female slot that corresponds to the male connector)
3. Seam/joint/gap (Space between two panels or the convergence of panels)
4. Internal wall/partition
5. Breezeway/hallway
6. Small T connector/rain-guard/weather-strip/space filler
7. Scenario/configuration/adaptation Furthermore let it be known that the following content of this patent is just a configuration, adaptations will be made according to manufacturing and the end product.

FIG. 30/B is a prospective profile view of I-beam male connector with finger holes.

FIG. 39/P is a prospective profile view of a male T-connector, shown with a cross-section/profile/junction between three panels, F. a piece of furniture island/table

DETAILED DESCRIPTION OF THE INVENTION

Figure 1:
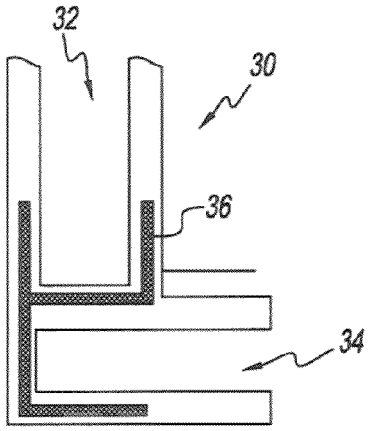
FIG. 1 is a cross-sectional view of a double channel-joining member for connecting a wall member to a floor member or a ceiling member, according to an exemplary embodiment of the present invention.

The following detailed description is of the best currently contemplated modes of carrying out exemplary embodiments of the invention. The description is not to be taken in a limiting sense, but is made merely for the purpose of illustrating the general principles of the invention, since the scope of the invention is best defined by the appended claims.

Various inventive features are described below that can each be used independently of one another or in combination with other features.

Broadly, an embodiment of the present invention provides housing for emergencies or for those in need. The housing could be short-term or may be set up as a longer-term shelter. The shelter may be flexible to grow and change enough to accommodate the individual, the family and the community. The shelter can be transported in a standard size truck bed (for example, 4 feet by 8 feet) and erected by two individuals in a minimal amount of time, typically less than an hour. The walls of the shelter may include various features, including shelving, bathing facilities, sinks, beds, lighting, and the like. Shelters are configured/designed to connected external electric and water supplies. Optionally, the shelters may be designed as stand-alone, "off-the-grid" units. The ceiling of the shelter may include one or more solar panels to provide power for the shelter. The shelter of the present invention may be assembled with few or no tools or additional hardware.

The shelter of the present invention are configured to be easily assembled and disassembled, easily transported, may not require tools are hardware and may have no small parts that could be lost. The shelter may be made of a strong, sturdy material, such as recycled plastic, recycled wood or the like. The shelter may be made of insulating materials, such as foam, or may be made with a dead air space to provide insulation. The shelter may be made of materials that result in a floating shelter, thereby providing security to occupants should water levels rise. The shelter may be transported in its own container, where the container may be used as a temporary water cistern, a compost container, or the like. The container may have its own wheels to aid in transport of the container and its contents. In some embodiments, the container may have one or more handles to further aid in the transport of the container and its contents.

Referring to FIGS. 1 through 7, a shelter 10 may be constructed from a floor member 12, a ceiling member 14, and a plurality of wall members 16. The dimensions and thicknesses of the elements in the figures are representative sizes and the product may be of various sizes, depending on application. In some embodiments, the floor member 12 and the ceiling member 14 may be formed from a plurality of individual members joined together with an I-beam connector 18. The ceiling member 14 may have one or more solar panels 28 disposed on an exterior thereof. The solar panels 28 may be used to provide power to the shelter 10 or to store power in a power storage device, such as a battery (not shown).

The wall members 16 may be joined together with the I-beam connector 18. In some embodiments, the I-beam connector 18 may be partially or fully hinged to form a door jam/hinge assembly 20. Similarly, smaller hinged connector 22 may be used for form a window 24 in the wall member 16.

Figure 2:
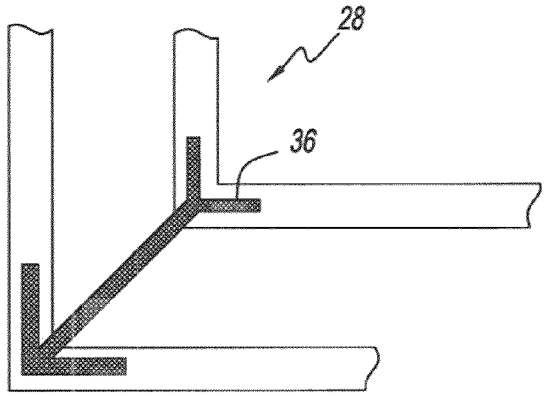
FIG. 2 is a cross-sectional view of a corner joint according to an exemplary embodiment of the present invention.

A corner member 26 may be used to join wall members 16 at a corner of the shelter 10. Angled members 28, 30 may be used to join the wall members 16 to either the floor member 12 or the ceiling member 14. One embodiment of an angled member 30 is shown in FIG. 1. Angled member 30 may hold a wall member 16 in slot 32, and the floor member 12 or the ceiling member 14 in the slot 34. A reinforcement 36 may be disposed within the angled member 30 to provide rigidity to the member 30. In some embodiments, the angled member 30 may be made of a rubber material, such as a material made from recycled tires, plastic, wood or the like. Another embodiment of the angled member 28 is shown in FIG. 2. Angled member 28 may be used to hold a wall member 16 with another wall member (becoming corner member 26), or with the ceiling member 14 or the floor member 12. Similar to angled member 30, angled member 28 may include the reinforcement 36. The reinforcement 36 may be formed of, for example, a rigid or semi-rigid plastic, metal or the like.

Figure 3:
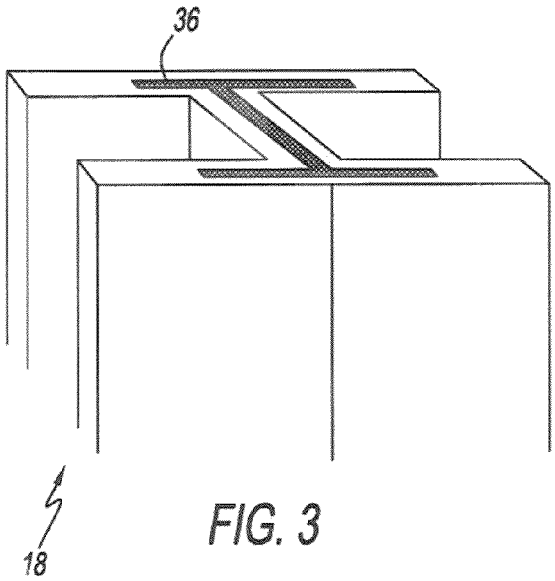
FIG. 3 is a perspective view of an I-beam channel joint according to an exemplary embodiment of the present invention.

FIG. 3 shows a perspective view of the I-beam connector 18. The reinforcement 36 may also be present inside the I-beam connector 18. The I-beam connector 18 may be used to connect sheet material together, such as two wall panels 16, floor panels of the floor member 12, ceiling panels of the ceiling member 14, or the like. Similar to angled members 28, 30, the I-beam connector 18 may be made of rubber, such as a material made from recycled tires, plastic, wood or the like.

Figure 4:
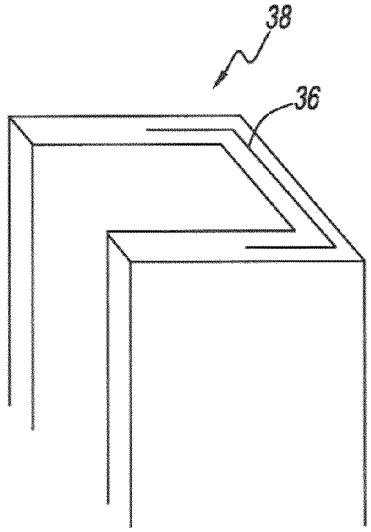
FIG. 4 is a perspective view of a finishing framing strip according to an exemplary embodiment of the present invention.

FIG. 4 shows a perspective view of a finishing framing strip 38. The strip 38 may be placed at an end of an internal wall, door or window. The reinforcement 36 may be installed in the strip 38.

Figure 5:
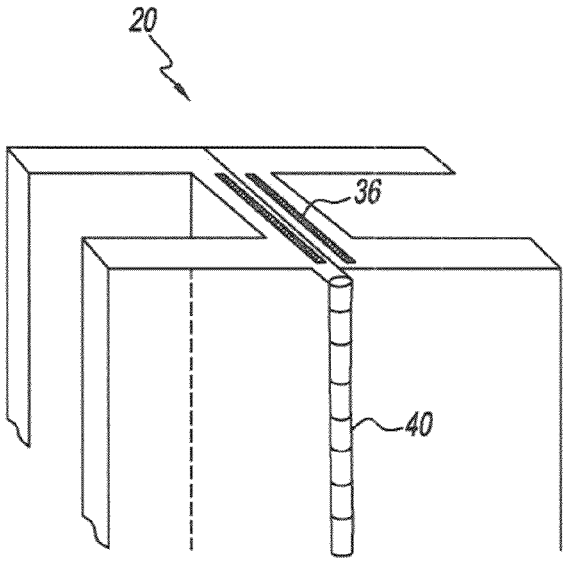
FIG. 5 is a perspective view of a door jam/hinge assembly according to an exemplary embodiment of the present invention.
Figure 6:
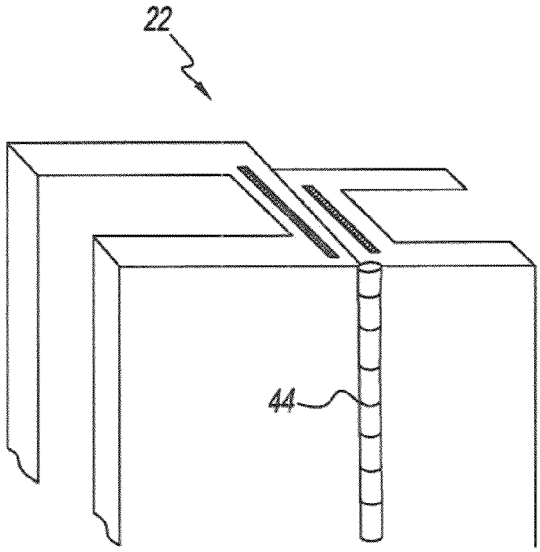
FIG. 6 is a perspective view of a window/cabinet door jam/hinge assembly according to an exemplary embodiment of the present invention.
Figure 7:
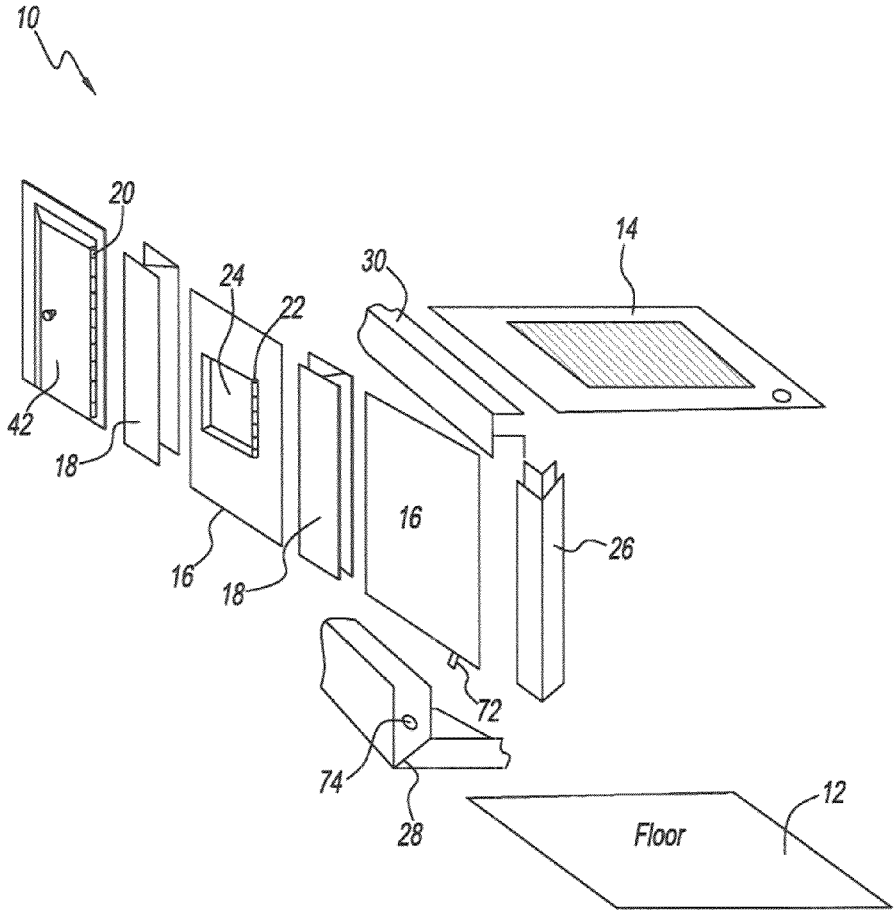
FIG. 7 is an exploded view of a portion of a shelter building according to an exemplary embodiment of the present invention.

FIG. 5 shows the door jam/hinge assembly 20. This assembly 20 may be similar to the I-beam connector 18, except that each half of the connector is connected with a hinge 40. The assembly 20 may permit a door 42 to be installed in the shelter 10. FIG. 6 shows the window/cabinet door jam/hinge assembly 22. This assembly 22 is similar to the assembly 20 in that a hinge 44 connects each half of the connector. The assembly 22 may permit the window 24 or a cabinet door (not shown) to be installed in the shelter 10. In both assemblies 20, 22, reinforcement 36 may be present to provide rigidity.

Figure 8A:
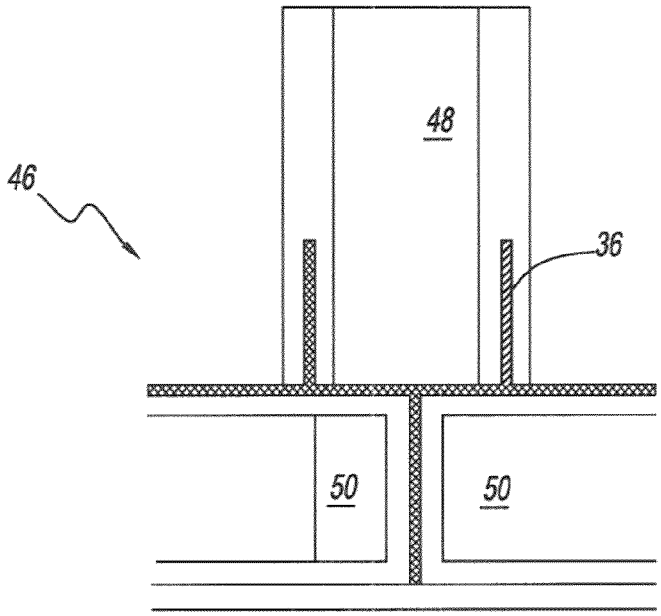
FIG. 8A is a cross-sectional view of a female T channel according to an exemplary embodiment of the present invention.
Figure 8B:
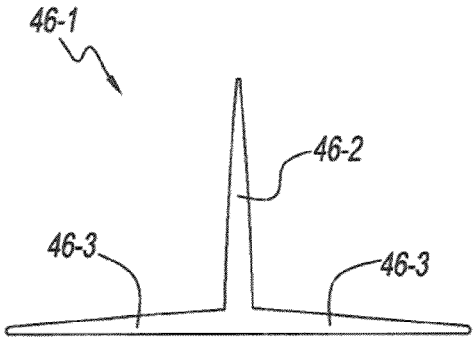
FIG. 8B is a cross-section view of a male T channel according to an exemplary embodiment of the present invention.

Referring now to FIG. 8, if an internal wall is desired, or if multiple shelters 10 are to be joined together (with a shared common wall), a T-channel connector 46 may be used. The wall member 16 may be inserted in slot 48 and floor or ceiling members 12, 14 may be inserted in slots 50. Similar to the other components described above, reinforcement 36 may be disposed in the connector 46 to provide support and rigidity thereto.

Figure 9:
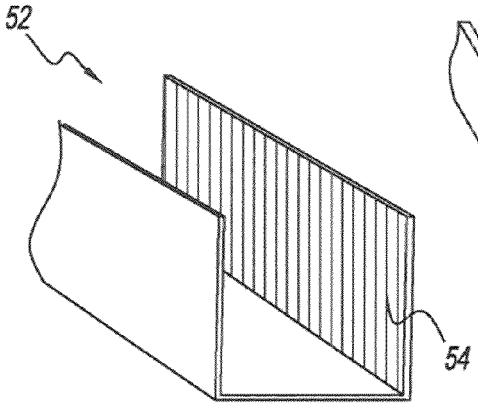
FIG. 9 is a perspective view showing ribbing inside female connectors, according to an exemplary embodiment of the present invention.

Referring to FIG. 9, a generic view of an inside of a generic connector 52 is shown. The inside of the connector 52 may include ribbing 54 to help with retention to components inserted in the connector 52. For example, the connector 52 may be the I-beam connector 18 and the component inserted in the connector 52 may be the wall member 16.

Figure 10:
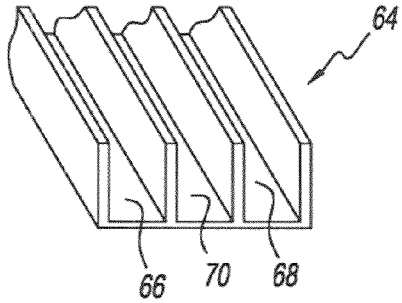
FIG. 10 is perspective view of a flex angle/corner member according to an exemplary embodiment of the present invention.

Referring to FIG. 10, a flex angle/corner connector 64 may include first and second female slot 66, 68 connected by a flexible web material 70. The flexible web material 70 may allow the connector 64 to be used as a corner connector, connecting two walls together at a 90° angle, for example. The flexible web material 70 may be weather proof, providing a seal between the inside and the outside of the shelter 10.

Figure 11:
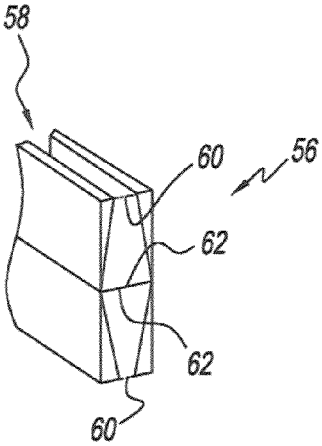
FIG. 11 is a perspective view of an I-beam according to an alternate embodiment of the present invention.

Referring to FIG. 11, an alternate configuration of an I-beam connector 56 is shown. The connector 56 may form a slot 58 that is narrower at outer ends 60 of the slot 58 and wider at inner ends 62 of the slot. The components placed into the slot 58, such as the wall members 16, may have a mating shape, thereby providing improved retention of components in the slot 48. While the I-beam connector 56 is specifically shown with this slot configuration, other components, such as the angled members 28, 30, the hinged members 20, 22, and the like, may have similar slot configurations.

Referring back to FIG. 7, the wall members 16 may include male pegs 72 adapted to fit into female receptacles 74 in components receiving the wall members 16, such as the angled member 28. These pegs 72 and receptacles 74 may help provide support to the assembled shelter 10.

The shelter 10 may include other items for supporting the assembled shelter 10. For example, the angled members 28 may have an anchor plate extending out from the angled member 28 along the ground on the outside of the shelter 10. The anchor plate may be used to secure the angled member 28 to the ground. Similarly, the ceiling member 14 may include support members extending from a periphery of the ceiling member 14. These support members may provide an anchor point for the shelter 10. For example, a tie down may be secured from the anchor point to the ground. A weather skirt (not shown) may be applied to the assembled shelter 10 around the joints, especially about the joint between the angled member 28 and the floor member 12.

Additionally, adjacent components may include attachment mechanisms, such as snaps, buckles, or the like, to connect the adjacent components together once assembled. For example, the wall member 16 may have one end of a buckle (not shown) and the I-beam connector 18 may have a mating end of a buckle. When the wall member 16 is assembled with the I-beam connector 18, the two buckle components may latch together. This configuration may not only help secure and strengthen the shelter 10, but may also help in the assembly of the shelter 10 by assuring the user that the parts are correctly assembled when the attachment mechanisms are aligned.

While the above FIGS. 1 through 11 describe the structural members (wall members 16, floor member 12 and ceiling member 14) being male parts and the connectors (such as I-beam connector 18 and angled members 28 and 30) being female, the opposite configuration may be realized within the scope of the present invention.

Figure 12A:
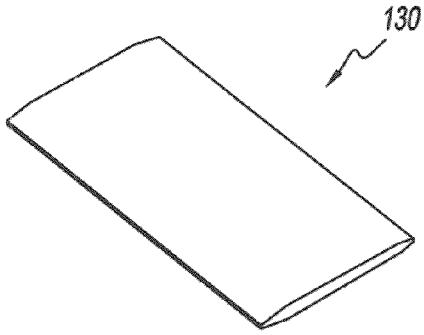
FIG. 12A is a perspective view of a rigid double male fitting adapted to connect two female members together, according to an embodiment of the present invention.
Figure 12B:
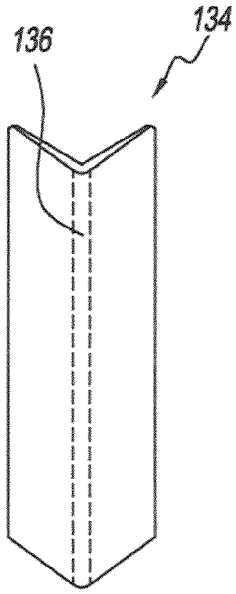
FIG. 12B is a perspective view of a double male fitting with a flexible center portion, bent at a 90 degree angle for use in a corner.
Figure 12C:
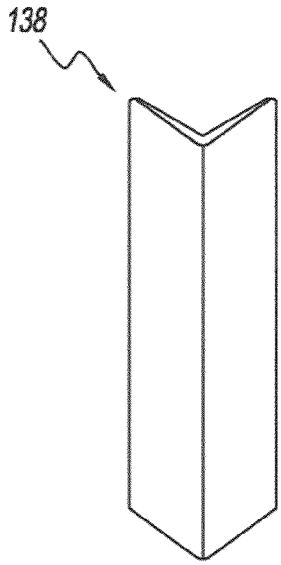
FIG. 12C is a perspective view of a rigid double male fitting for use in a corner, according to an exemplary embodiment of the present invention.

For example, referring to FIGS. 8B, 12A, 12B and 12C, the wall members may have female slot on each side thereof, while the connector to connect the wall members may be a male-to-male flat member 130 adapted to fit into adjacent slots as shown in FIG. 12A. While FIGS. 12A, 12B and 12C show tapered male fittings (to fit in tapered slots), the fitting may also be straight or may be flat with crimped ends to help guide the member 130 into a female slot. Along this line, the floor member may have a female slot around its periphery. A male-to-male flexible member 134 may fit into the female slot in the floor's periphery. The member 134 may include a flexible member 136 allowing the member 134 to flex at 90 degrees to attach to a female slot in a wall member. A mechanical retention member may be used to help secure the wall members while the shelter is being built. Similarly, corner members 134, 138 may be designed to hold adjacent wall members (with female sides) at a corner. In some embodiments, the corner member 134 may have a flexible portion 136 along the central region thereof. The flexible portion 136 may be made of rubber, plastic (such as a living hinge), or the like.

Other previously described elements that were shown as female members may also have male fittings in place of the female fittings. For example, the T-connector of FIG. 8 may be formed as a male T connector 46-1 having male fittings 46-2, 46-3 on each end thereof. In some embodiments, a T-connector may have one or more male fittings and one or more female fittings. Other fittings, such as the hinged fittings of FIGS. 5 and 6, may be similar designed with male connectors.

In some embodiments, the wall members may have one side male and one side female, allowing wall members to be connected together without a connector there between. One example of this configuration is described with reference to FIGS. 13 through 20, as described below.

Referring to FIGS. 13 through 20, a shelter 80 may include a plurality of wall members 82, a plurality of floor members 84 and a plurality of ceiling members 86. The ceiling members 86 may have a water diverting V-shape 104 for urging water, such as rainwater, in a particular direction, such as toward a cistern. The wall members 82 may have a female slot 88 along one side thereof and a male fitting 90 on a second, opposite side thereof. The wall members 82 may have a male fitting 92 on a top side thereof. The wall members 82 may have an overhanging tab 94 adapted to overhang the floor members 84. A female slot 95 may be formed in the bottom side of the wall member 82. The slot 95 may align with a male fitting 110 on the floor member 84. Adjacent wall members 82 may be joined together by inserting the male fitting 90 of one wall member 82 into the slot 84 of an adjacent wall member.

Figure 14:
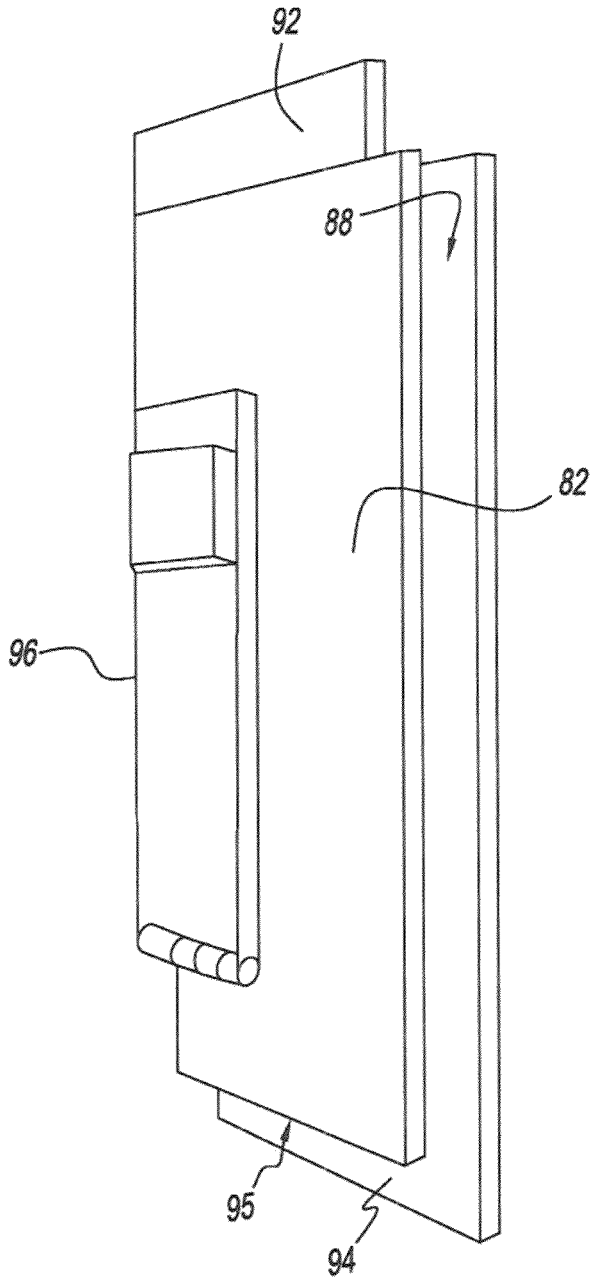
FIG. 14 is perspective view of a siding panel used in the shelter of FIG. 13.
Figure 15:
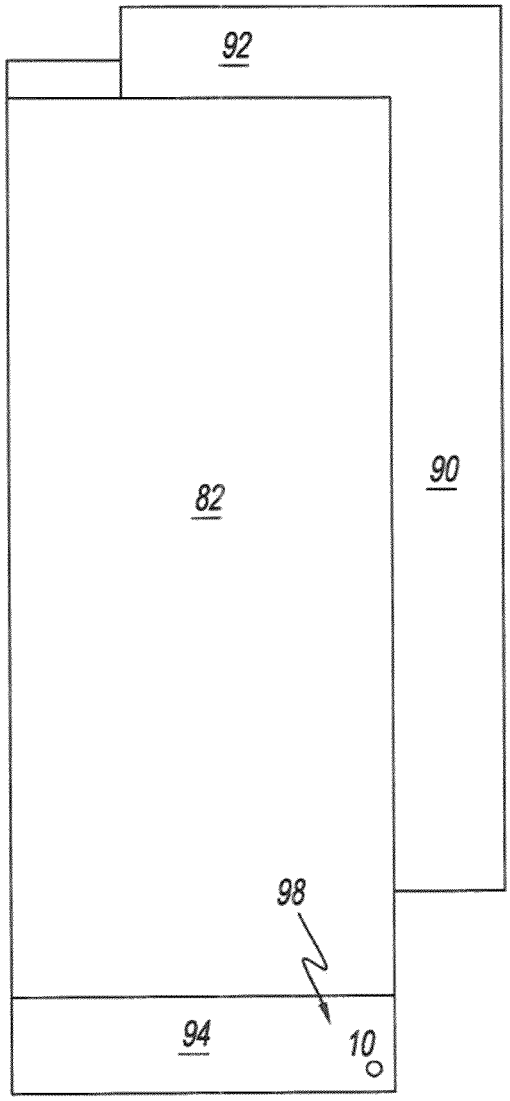
FIG. 15 is a perspective view of the siding panel of FIG. 14.

As shown in FIG. 14, some wall members 82 may have accessories attached to an inside of the wall member 82. For example, a bench seat 96 may be pivotally attached to the wall member 82. The bench seat 96 may fold against the wall (as shown in FIG. 14) for transport, storage, or when not in use, or the bench seat 96 may fold down to provide a seat for people. The wall members 82 may include a label 98, matching with labels on other members, for ease of construction. The labels 98 may be, for example, numbers, which not only provide a means to match parts, but also an order for ease of assembly.

Figure 16:
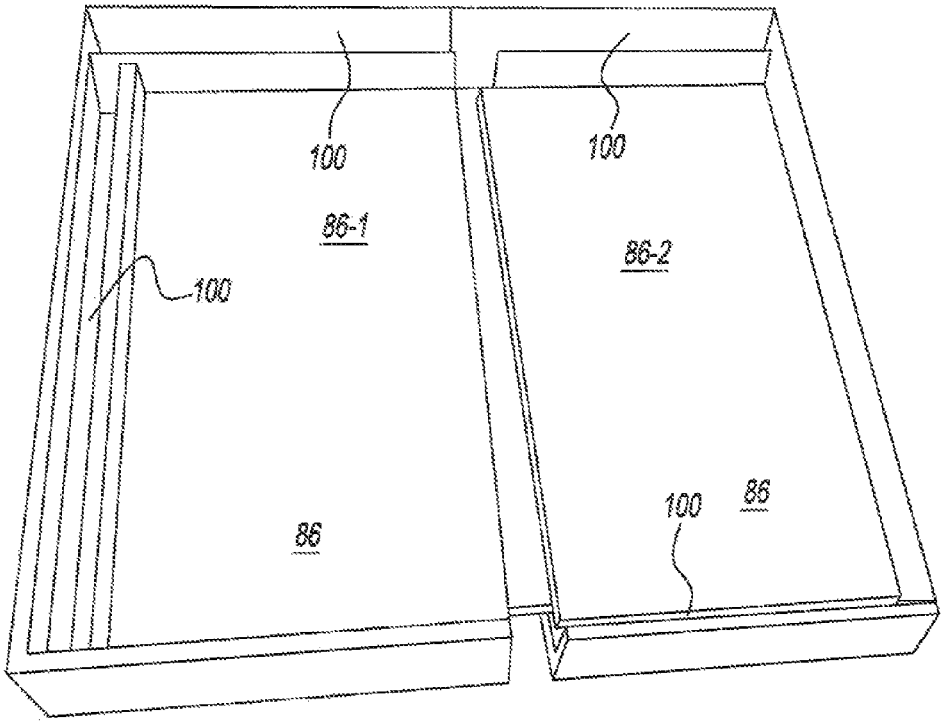
FIG. 16 is a perspective view of a ceiling member of the shelter of FIG. 13, partially assembled.

Referring to FIG. 16, a plurality of ceiling members 86 may attach together, similar to the wall members 82, to form a shelter roof. A slot 100 may be disposed about the periphery of the shelter roof to permit the male fittings 92 of the wall members 82 to fit therein. The ceiling members 86 may include end members 86-1, having the slot 100 formed on three sides thereof, and middle members 86-2, having the slot 100 formed on two, opposite sides thereof. This configuration permits the length of the shelter 80 to be customized through the additional of more or fewer middle members 86-2. In some embodiments, if the width of the ceiling members 86 is not large enough, ceiling members can be added to the ends of the end members 86-1 by providing similar slots and fittings.

Figure 17:
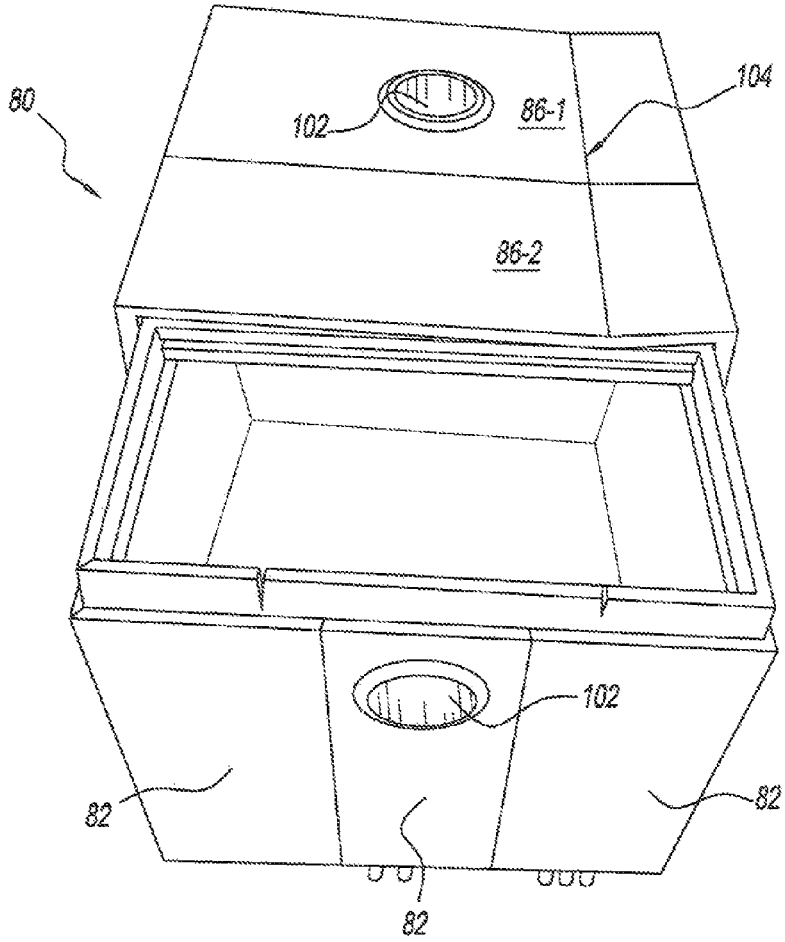
FIG. 17 is a perspective view of the shelter of FIG. 13, partially assembled.

FIG. 17 shows the shelter 80 with the roof partially assembled. A window 102 may be provided in the roof to provide light. The window 102 may be any convenient shape, such as round (as shown), square, oval, rectangular, or the like. While the window 102 is shown on end member 86-1, the window 102 may be installed in any of the ceiling members 86. Moreover, the window 102 may be formed in one or more wall members 82. The ceiling members may be slightly angled horizontally to provide a water drainage channel 104. This channel 104 may divert water from the roof to another location, such as a cistern.

Figure 13:
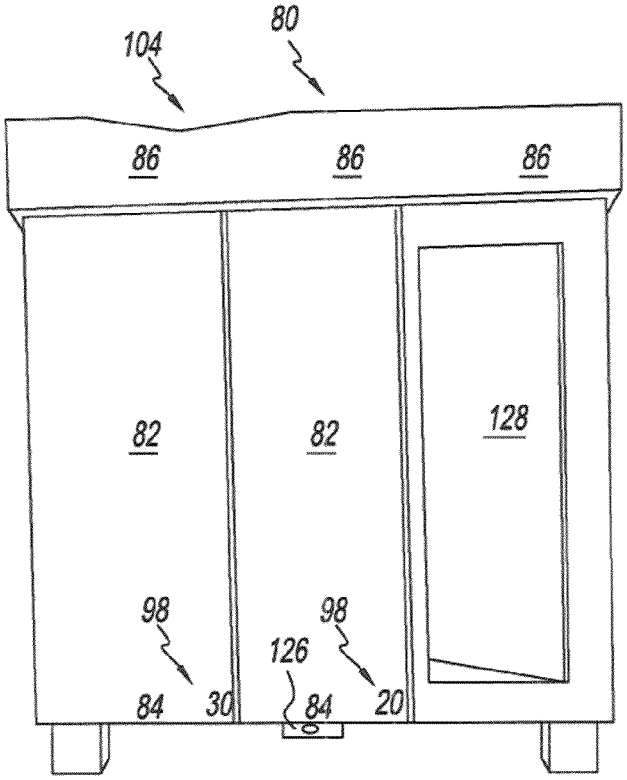
FIG. 13 is perspective view of a shelter according to an alternate embodiment of the present invention.
Figure 18:
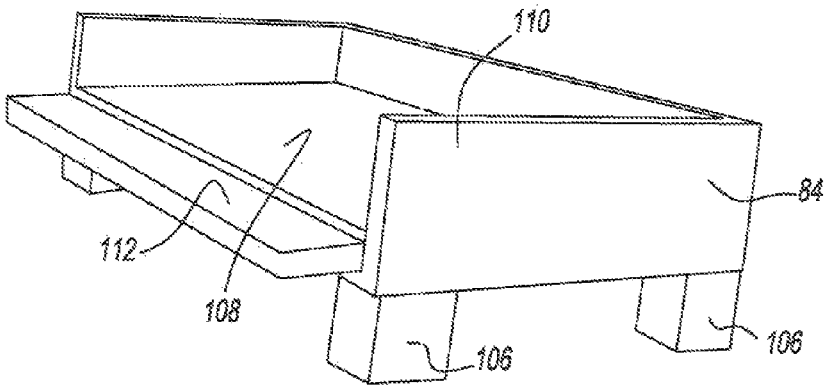
FIG. 18 is a perspective view of a floor member of the shelter of FIG. 13, partially assembled.

FIG. 18 shows one floor member 84. The floor member 84 may include feet 106 to raise the floor 108 off the ground. The feet 106 may be adjustable feet, having any type of feet adjustment means, such as a threaded adjustment, a ratchet adjustment, or the like. The floor member 84 may include a plurality of male fittings 110 extending substantially orthogonal to the floor 108 about the periphery of the floor member 84. The fittings 110 may provide a mating member for the slots 95 (see FIG. 14) in the wall members 82. The floor members 84 may join together in a manner similar to that described above for the ceiling members 86. For example, a male fitting 112 may be disposed along one side of a ceiling member. The fitting 112 may be inserted into a slot of another ceiling member 84. The floor members 84 may have a level 126 as shown in FIG. 13.

Figure 19:
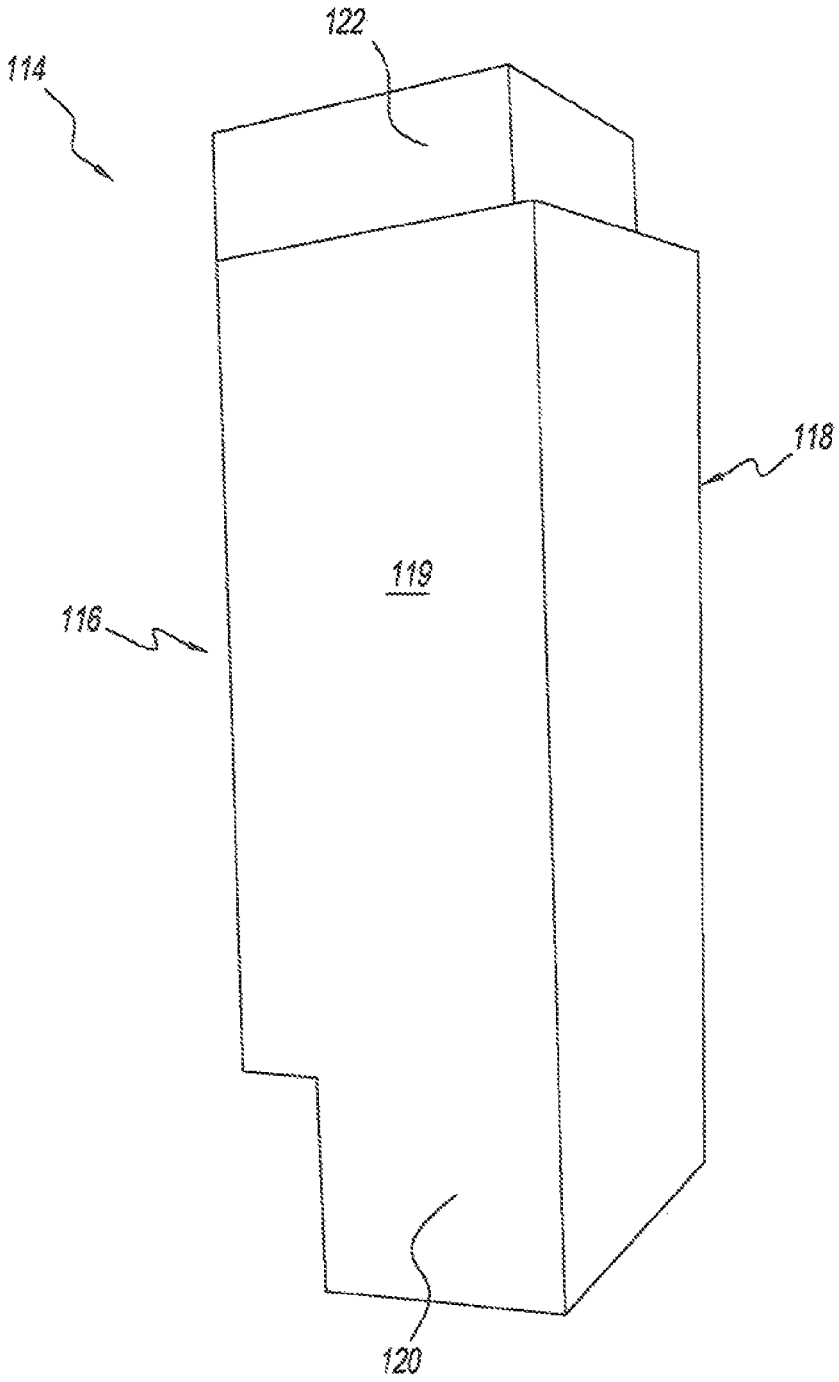
FIG. 19 is a perspective view of a corner member of the shelter of FIG. 13, partially assembled.

FIG. 19 shows corner members 114 that may be used to form corners of the shelter 80. One side of the corner member 114 may include a slot 116 and the other side of the corner member 114 may include a male fitting 118. An overhang portion 120 of the corner member 114 may be designed similar to the wall members 82, allowing the corner member 114 to be installed on the floor member 84. A top male fitting 122 may be formed along the top of the corner member 114 for attachment to a ceiling member 86.

Figure 20:
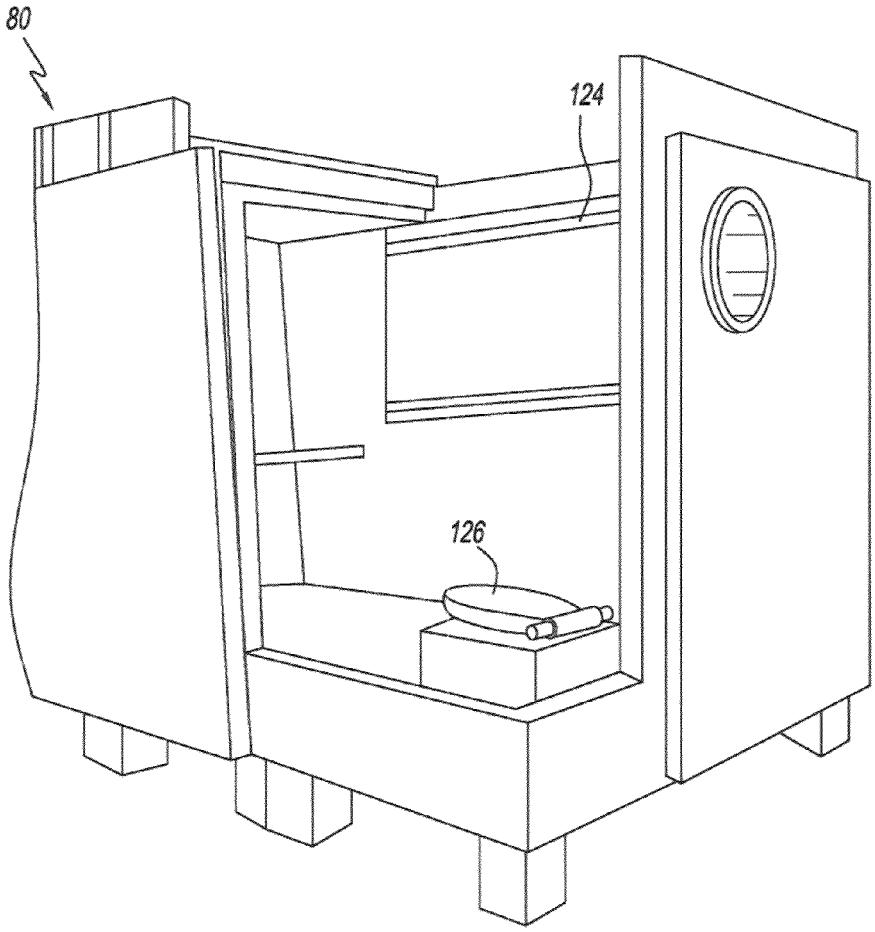
FIG. 20 is a perspective view of the shelter of FIG. 13, partially assembled.

FIG. 20 shows a partially disassembled shelter 80. Additional accessories may be installed inside the shelter 80. For example, beds 124 may fold down from one wall member 82. A compost commode 126 may be disposed in one portion of the shelter 80. Other accessories may include sinks, showers, curtains, tables, and the like.

A door 128 or windows (not shown) may be formed in one or more wall members 82 or ceiling members 86 by conventional methods.

Similar to the shelter 10, the shelter 80 may include latching mechanisms for joining adjacent structural members (such as wall members to adjacent wall members, or wall members to ceiling members or wall members to floor members).

In some embodiments, the shelter 80 (or the shelter 10) may be provided as a kit. The kit may include a disassembled shelter in a container. The container may include the shelter parts, ladders for assembly and the accessories for the shelter. The container may also be used as a component of the shelter—for example, as a cistern, a compost container, of the like.

The shelter 80 may include connections for electric and water from an outside source. The shelter 80 may include connections for taking wastewater away. The shelter 80 may be used as a stand-alone shelter (so-called, off the grid) or may be connected to outside services, such as electric.

The fittings and slots of the shelter 80 may, similar to that described above with reference to FIG. 11, may be tapered to provide a positive connection between adjacent components.

DETAILED DESCRIPTION OF THE INVENTION

Although the components of this present invention; panels with female slot that correspondent to male connectors, with mechanical retention, are configured to be used to make many items; in this embodiment of the present invention broadly provides sleeping capsule, housing for emergencies or for those in need, homeless, refugees and homes for low-income people to own. The housing could be short-term or may be set up as a longer-term shelter. The shelter can be disassembled and made larger shown in FIGS. 46 and 47. The shelter is flexible to grow and change enough to accommodate the individual, the family and the community. In addition to emergency situations the components used to build the shelter can be used for the general public. For example it could be used for a vacation home, mother-in-law's apartment, guest house, pool house, office, workshop, studio, storage unit, storage unit with a bounce back on it, portable offices and so on. The smaller shelter and a sleeping-capsule can be transported in a standard size truck bed (for example, 12 feet by 16 feet) and erected by two individuals in a minimal amount of time. Furthermore sleeping capsule can be made out of the same components; 0 a panel with female slot course finding to a male connector. Shelters are configure/designed to connected external electric and water supplies. Optionally, the shelters may be designed as stand-alone, "off-the-grid" units.

Figures 36, 37, 38, 39F, 39P:
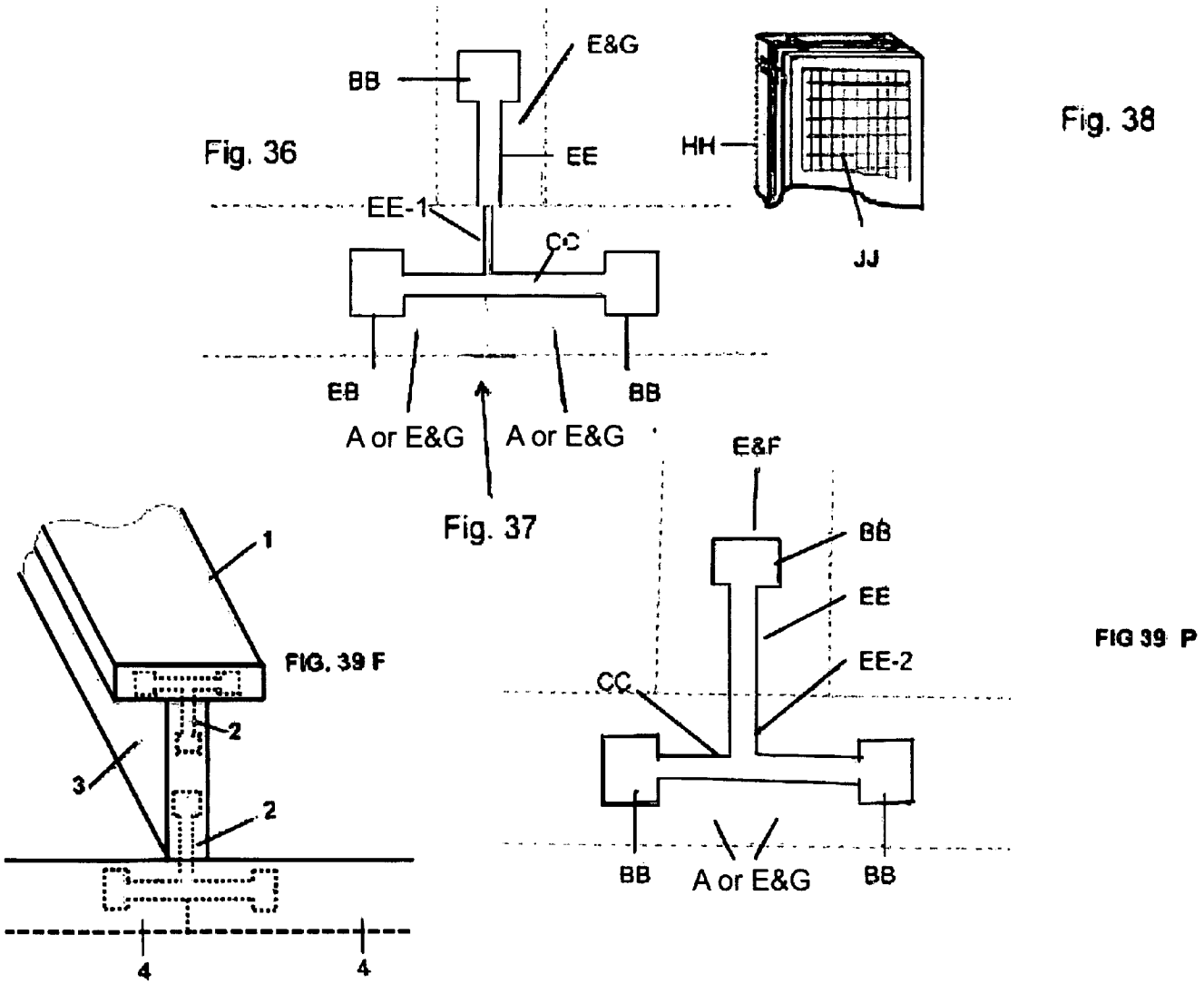
FIG. 36 is a prospective view of a modified male T-connector shown with cross-section/profile/junction between three panels.
FIG. 37 is a prospective small male T-connector.
FIG. 38 is a perspective view of a panel with flanges, cooling/infrared cell.

The walls of the shelter are configured to support include various features, including kitchen countertops/cabinets, kitchen island/table, desk, couch, shelving, bathing facilities, sinks, beds, lighting, and the like. For example a counter top may be supported by means of the male T-connector, shown in FIGS. 36 and 39P. The exterior walls are shown in FIG. 39/P or 36 as the lower two panels E&G. These two panels are joined together by the horizontal/I-beam part of the male T-connector. The countertop panel shown FIG. 36 or 39/P as the upper one panel E&G connected by vertical part of male T-connector. Furthermore the vertical part and or the horizontal part of the male T-connector may be diminished in size to accommodate smaller interior panels make for example an interior wall and or countertop. Not shown.

Figure 42:
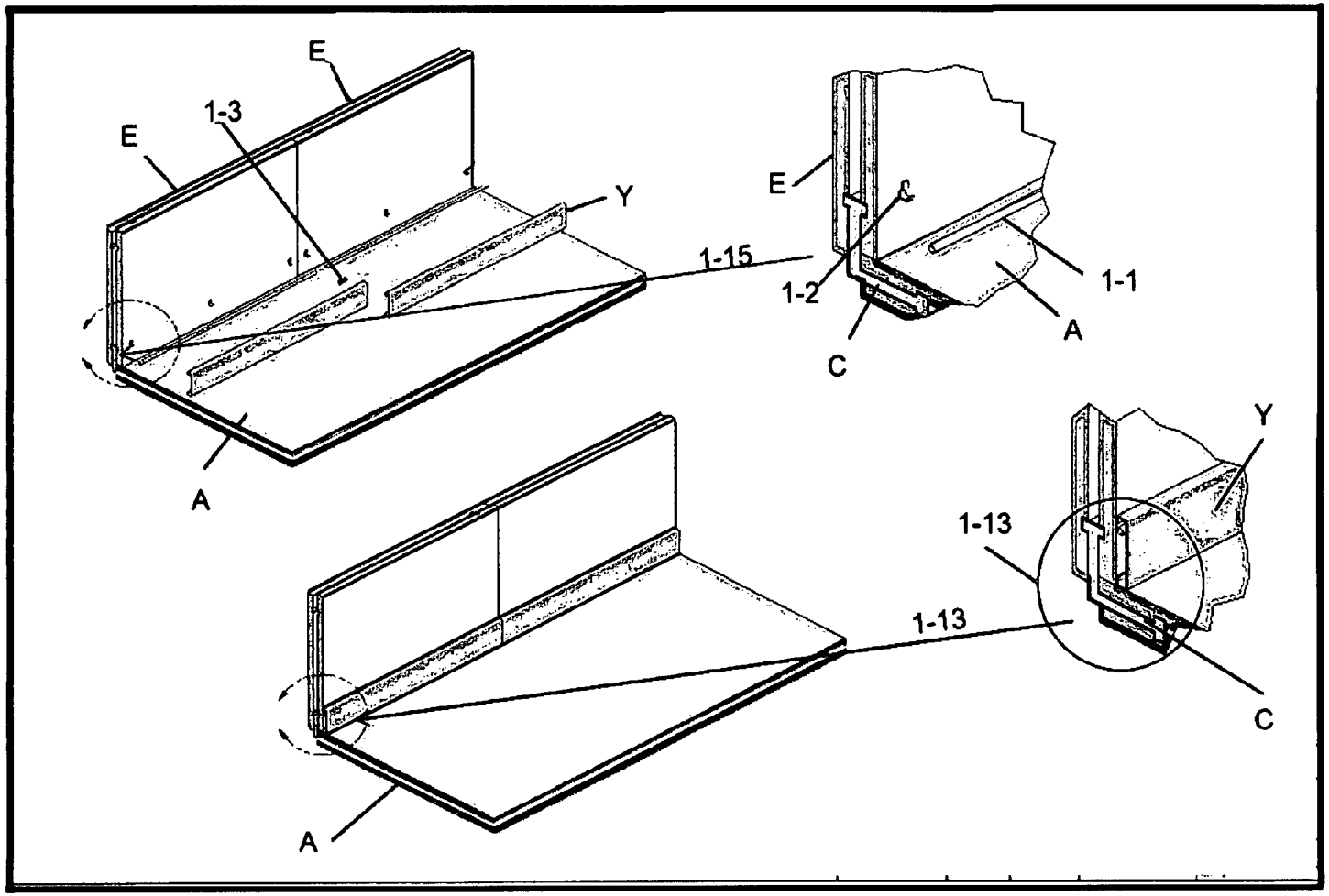
FIG. 42 is a perspective view of a waterline assembly.
Figure 43:
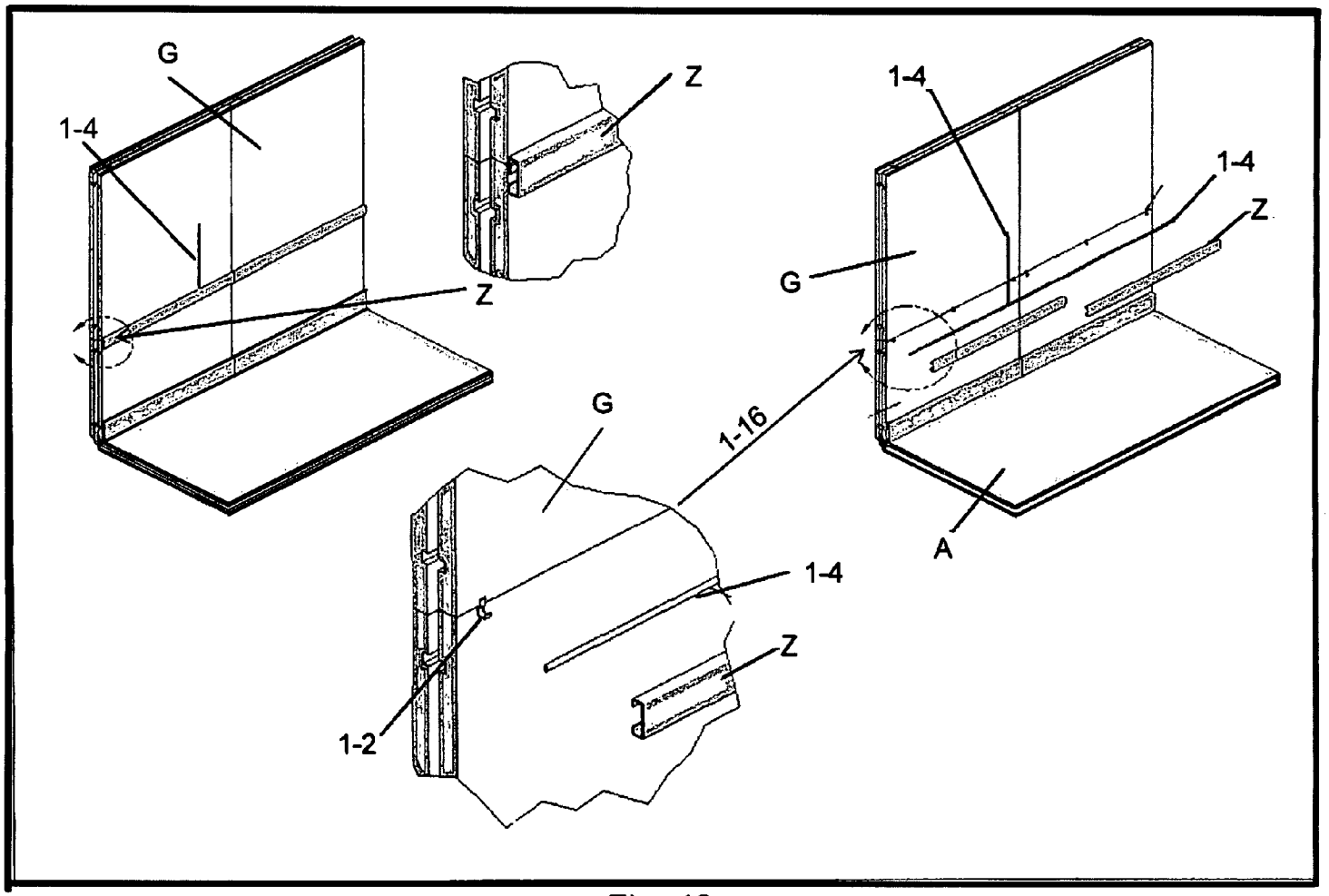
FIG. 43 is a prospective view of an electrical assembly.

The shelters may be configured/designed to connect to external electric and water supplies shown in FIGS. 42 & 43. Optionally, the shelters may be designed as stand-alone, "off-the-grid" units. The ceiling of the shelter shown in FIG. 50 1-10 may include a configuration of one or more solar panels to provide power for the shelter. The shelter of the present invention may be easily assembled and disassembled, easily transported, may not require tools are hardware and may have no small parts that can be lost.

As shown in FIG. 38 JJ Infrared cells and or cooling cells may be configured into baseboards and or panels for heating and cooling. It may be powered by conventional or alternative energy sources for power. Furthermore other types of air-conditioning and heating can be configured into shelter in geographic areas that have the need.

The shelter may be configured of a strong, sturdy material, such as recycled plastic, wood. Other materials could include plastic, rubber metal, wood, cement or any other materials such as different types of polymers or any new materials as they become available. The panels may have a configuration that will hold or be made of Ballistic material needed in some parts of the world. Insulating materials can be foam or air space or a combination thereof. The shelter may be made of materials that result in a floating shelter, thereby providing security to occupants should water levels rise. Furthermore the air space could be filled with water sand or gravel.

Figure 51:
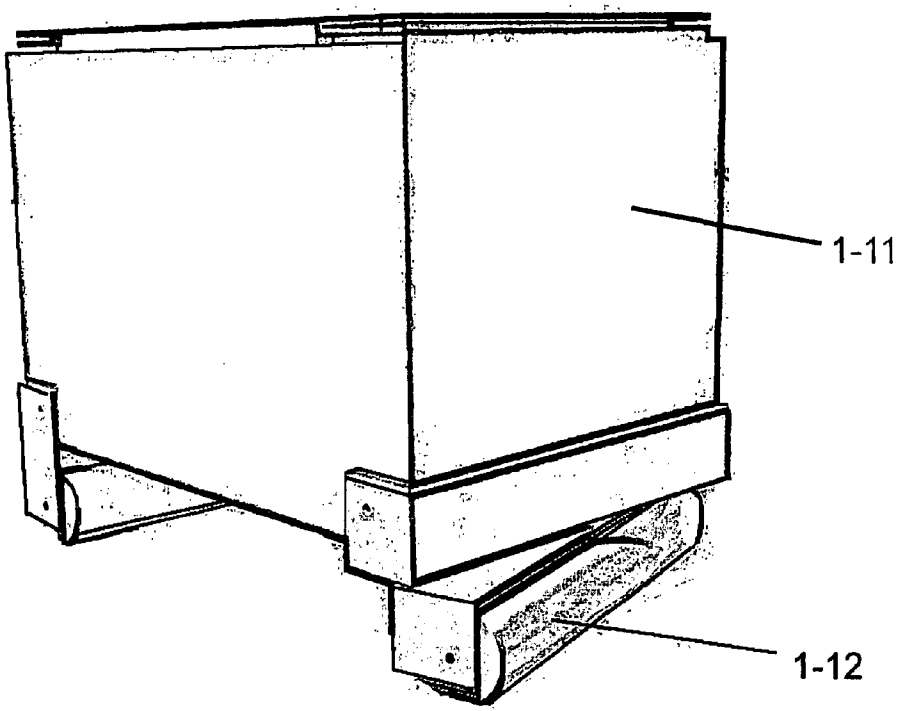
FIG. 51 is a perspective view of a container.

The shelter may be transported in its own container shown in FIG. 51. This shipping container is made from the same components: members/panels with female slot with the corresponding male connector/fitting. These components will be taken apart and used as part of the shelter or the container may be used as a water cistern, a compost container, or the like. The container may be configured to have its own wheels shown in FIG. 51 1-12 to aid in transport of the container and its contents. In some embodiments, the container may have a configuration of a hitch, and or have one or more handles to further aid in the transport of the container and its contents. Not shown.

In this shipping container one will find all the components and parts needed to build the emergency shelter and all the provisions one would need an emergency situation and sustainable living. Provisions and shelter will be configured/modified for different Geographic location. In an emergency situation, this container with shelter and provisions will be god sent. Just think no waiting in multiple lines to get the basic necessities for sustaining life. This container could be air lowered/dropped into remote locations. Aiding stranded people below.

Both a configuration of an Electrical wiring shown in FIG. 43 1-4 and waterline seen in FIG. 42 1-1 will be housed behind either a removable baseboards seen in FIG. 42 Y. and or chair-rails seen in FIG. 43 Z. Both a configuration of traditional and or solar power may be used for power.

Evaporation may be used to keep things cool; a simple cooling system may be configured, using a configuration of wet fabric and/or a water misting system. An alternative energy fan could also be added. Not shown.

Panels with female slots come in many different shapes and sizes depending upon the need. The shape is dependent upon the needs of the people and their geographic area. A shelter could be square, rectangle, round, dome or octagonal. See FIG. 33 for a curved panel. A curved panel with female slot corresponds to a semi-flexible and or curved male connector to create a circular or done shape shelter not shown. Furthermore the panels can be hollow, using dead airspace for installation or filled with water Gravel or sand.

For an octagon shaped shelter may be configured with flat panels with female slot corresponds to a male connector with a slight angle may be used, not shown. Panels may contain a configuration of exterior holes for plumbing and or power lines (with a plug when not being used). A Floor panel may have a configuration of a low shower basin and or slop for showers to allow water to drain. A wall panel may a configuration enabling means to connect hooks or other mechanisms for attaching different items, not shown.

Figure 48:
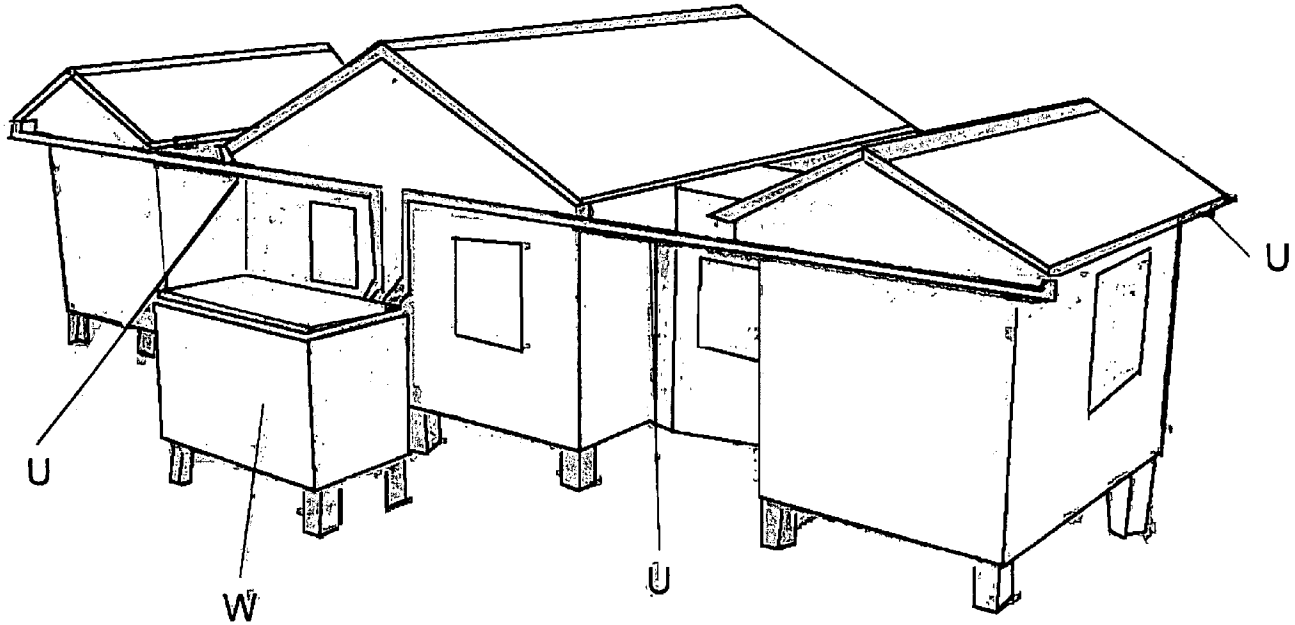
FIG. 48 is a perspective view of a Water Collection System.

A counter top panel may contain a configuration of a water basin. Roof panels, wall panels and other panels may be made in one piece or in multiple sections and be put together with I-beam male connectors. To route water into a cistern, as seen in FIGS. 48 & 49 a configuration of a Roof panel having female slots on three sides with a rain gutter on the fourth outer edge.

Figure 50:
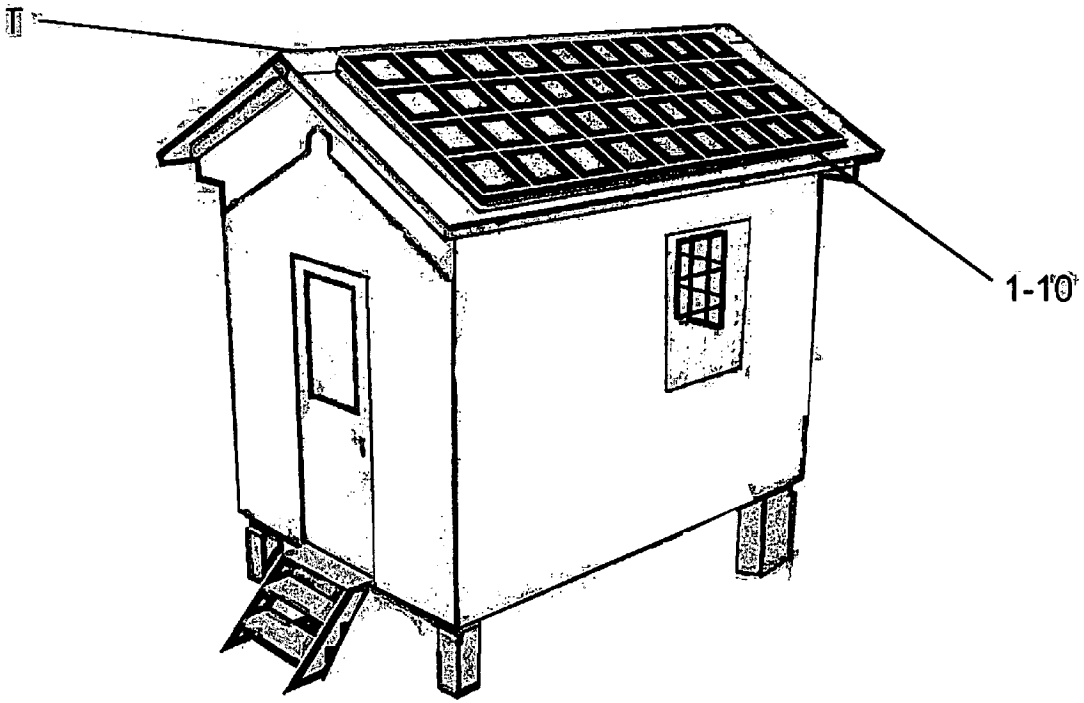
FIG. 50 is a perspective view of a solar panel.

As seen in FIG. 21R. a configuration of a smaller roof panel with female slots on one edges and a rain gutter on the outer edges, not seen, fills in the space over end truss creating an overhang. A roof panel may contain configuration of a venting fans, skylight not shown. A roof member/panel may contain a configuration of a solar cell, as shown in FIG. 50 U.

Figure 49:
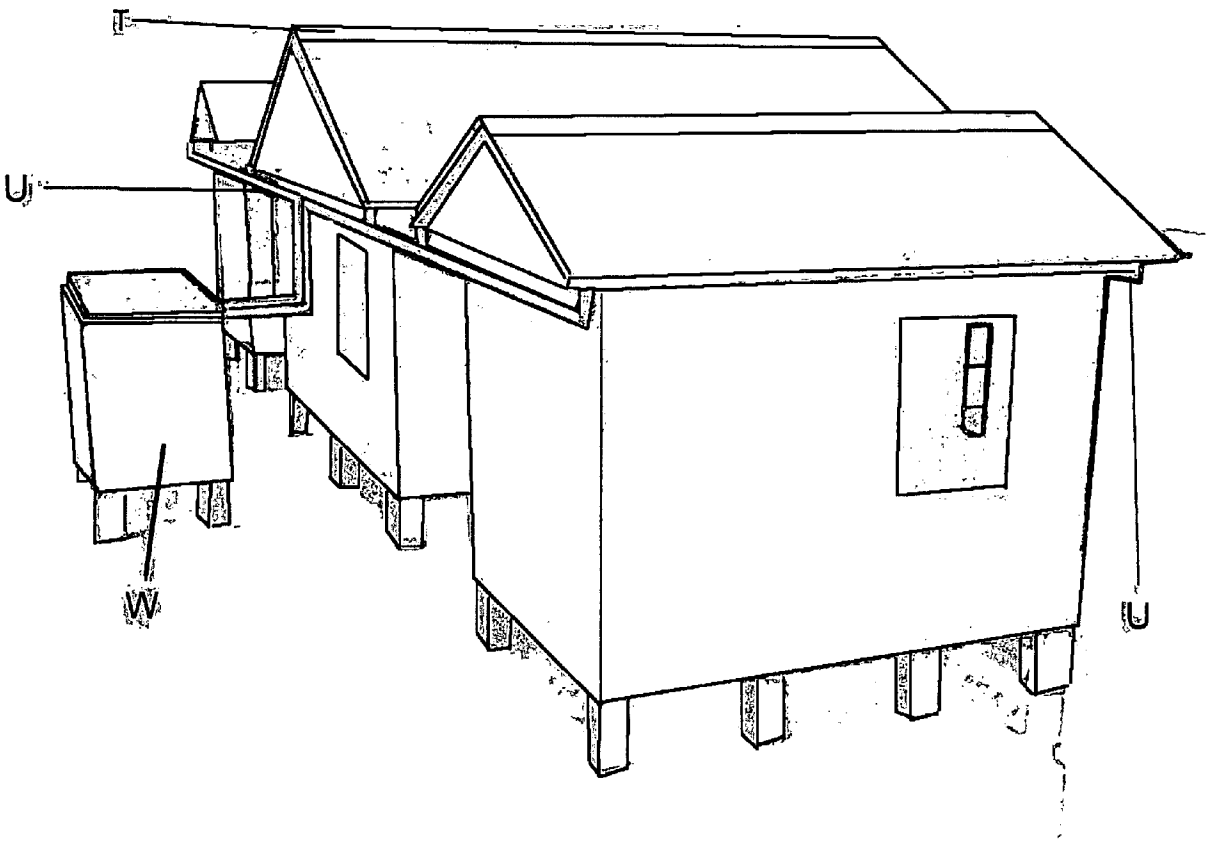
FIG. 49 is yet another perspective view of a Water Collection System.

A roof member/panel may contain a configuration of a ridge vent system, as shown in FIG. 49 T.A roof member/panel may contain a configuration of an exterior hole (with plug when not use) to accommodate wires or any other outside connection, not shown.

A trust panel with female slot that correspond to male connectors, may have a configuration of sections that are connected by and I-beam male connector. An end truss assembly may contain a configuration of an air vent not shown.

The male connector having a configuration of a diminishing and expanding bodies create a profile, giving the connector mechanical retention as seen in the perspective FIG. 30/B BB. This profile/mechanical retention can be any shape in the perspective drawing it is the shape of a dumbbell. Some male connectors will not have all sides with mechanical retention for ease of assembly and disassembly. Connectors may have a configuration of semi-flexible and or curved to accommodate rounded shaped panel FIG. 33. The angle of the male connector may change to accommodate the shape of the shelter. For ease of retraction the male connector at its end profile may have a configuration of finger holes and or some kind of mechanism. The panels have female slots that correspond to male connectors as seen throughout the perspective figurers. This scenario/configuration of panels with female slot that correspond to male connectors, negate the need for tools hardware. This eliminates both losing and dealing with small parts.

Figure 21:
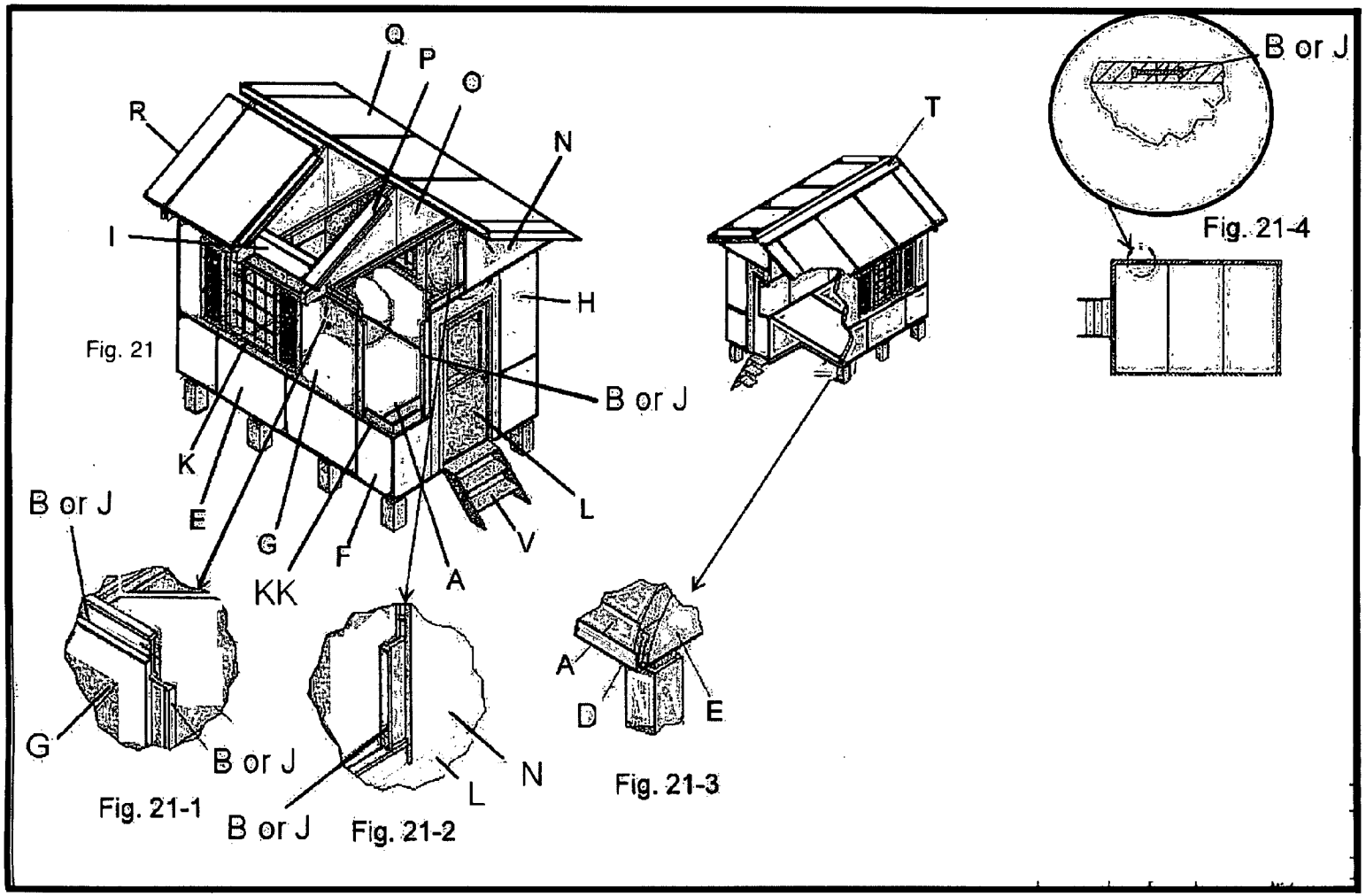
FIG. 21 is a perspective view of a cross-section of a small Shelter Assembly.

FIG. 21 is a perspective view of a cross-section of a small Shelter Assembly with a plurality of panels with female slots that correspond to male connectors according to the embodiment of the present invention. The following letters corresponds: A. floor panel. B. Floor panel I-beam male connector (connects panels: wall to wall, floor to floor, wall to truss, roof to roof), C. 90° male connector, (connects panels: floor to wall) E. Lower wall panel, F. Lower outside corner panel, G. Upper wall panel, H. Upper outside corner panel, I. Air block wall panel (closes gap between top of wall and roof panel) J. Wall panel I-beam male connector (connects Wall panel to wall panel), Note B. and J. are the same. K. Upper wall window panel with or with out bars may contain shutters an awning, L. door panel, N. Truss (end left), O. Truss (mid left/right), P. male T-connector, KK, 90° Corner section male Connector, Q. Standard roof panel, R. End roof panel (right), T. Ridge vent section, V. (3) step stair. a wall panel.

As shown in FIG. 21 the Roof Assembly is comprised of Q. roof panel with female slot that connects to O. Truss panel with female slot, by means of the corresponding P. male T-connector. As shown O. Truss panel with female slot connects to G. wall panel with female slot, by means of the corresponding I-beam/male connector. As shown in FIG. 21-1 a cross-section of a corner, H. Upper outer corner panel with female slot (not shown) connects to adjacent wall panels by means of J./B. an I-beam male connector; F. Lower outside corner connects to H. upper outside corner by means of KK. corner-section male connector in-turn F. lower outside corner panel connects to A. Floor panel by means of D. 90° corner male connector.

As shown in FIG. 21 the floor comprised of multiple floor panels with female slot connect together, by means of multiple corresponding I-beam male connectors. Not shown.

FIG. 21-1 is it detailed drawing of a cross-sectional corner showing G. Upper wall panel, B. I-beam male connector I. Air block panel.

FIG. 21-2 is a detailed drawing of the connection between N. Truss panel (end Left) L. Door panel, by means of B. I-beam male connectors.

FIG. 21-3 is a detailed drawing of a cross section of a connection between A. Floor panel E. Lower outer corner panel, by means of D. 90° corner male connector. Furthermore it shows floor members are disposed away from a surface by a plurality of adjustable feet or a concrete riser connected to the floor panel having a release mechanism to release the shelter from the riser, enabling the shelter to be dismantled, or a riser comprised of a heavy coiled spring allowing the shelter to move with the earth. (Not Shown)

Figure 22:
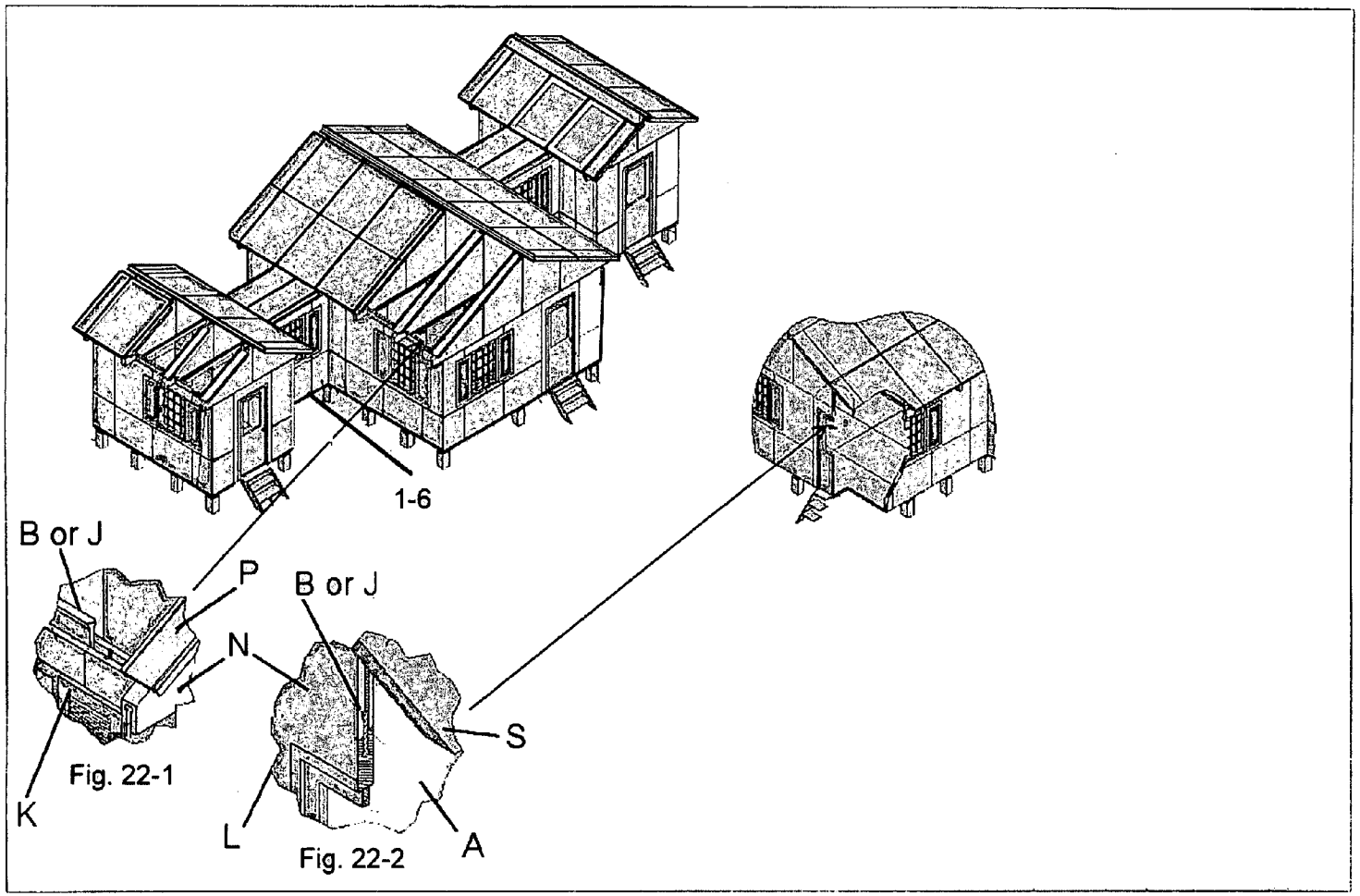
FIG. 22 is a prospective view of a Large Shelter Assembly, three shelters connected together by 1-6 Breeze-way/hallway.

FIG. 22 is a prospective view of a Large Shelter Assembly, three shelters connected together by 1-6 Breeze-way/hallway. It is constructed from a plurality of panels with female slots that correspond to male connectors according to the embodiment of the present invention.

FIG. 22-1 is a cross-section of corner, N. Truss panel (end left), K. Upper wall window panel, B. I-beam male connector, and P. maleT-connector.

Figure 23:
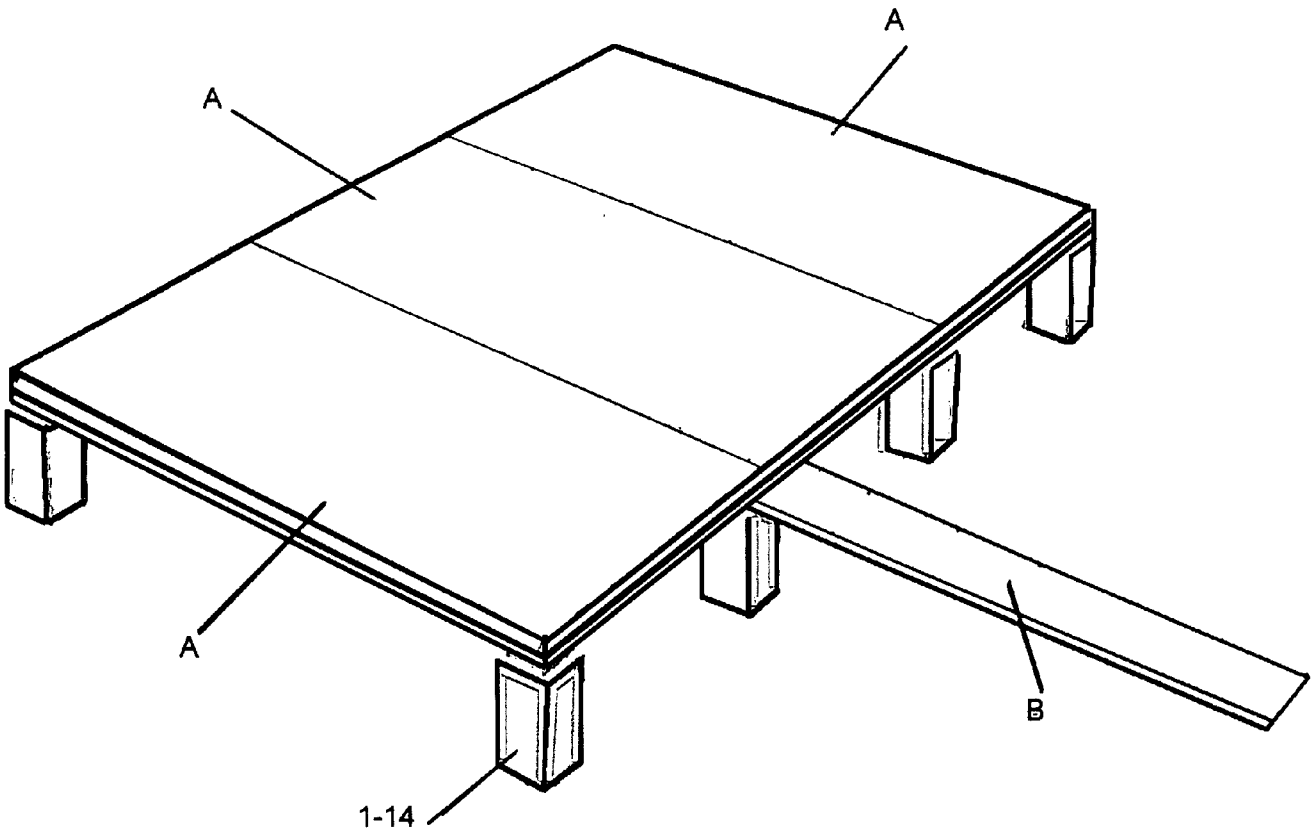
FIG. 23 is a perspective view of a partly assembled shelter, with Floor panel assembly and I-beam male connector.

FIG. 22-2 shows a cross-section of a typical joint, N. Truss panel (end left), and L. Door wall panel, connected by B. I beam male connector FIG. 23 is a perspective view of a partly assembled small shelter, A. Floor panels with female slot corresponds to Fig. B. I-beam male connector. A concrete riser as shown in FIG. 1-14 and FIG. 21-3 concrete riser with a detail drawing of the junction between the floor panel and a concrete riser. The floor panel may have a configuration of a release mechanism that could release the shelter from the riser, enabling the shelter to be dismantled. Not shown. Furthermore the Riser in earthquake areas may be comprised of a heavy coiled spring. Allowing this shelter to move with the earth. Not shown. For added support the riser may be configured with a member going through the floor panel and being secured from inside. Yet another option for areas that are weather friendly is a typical anchor system such as used with mobile homes.

Figure 24:
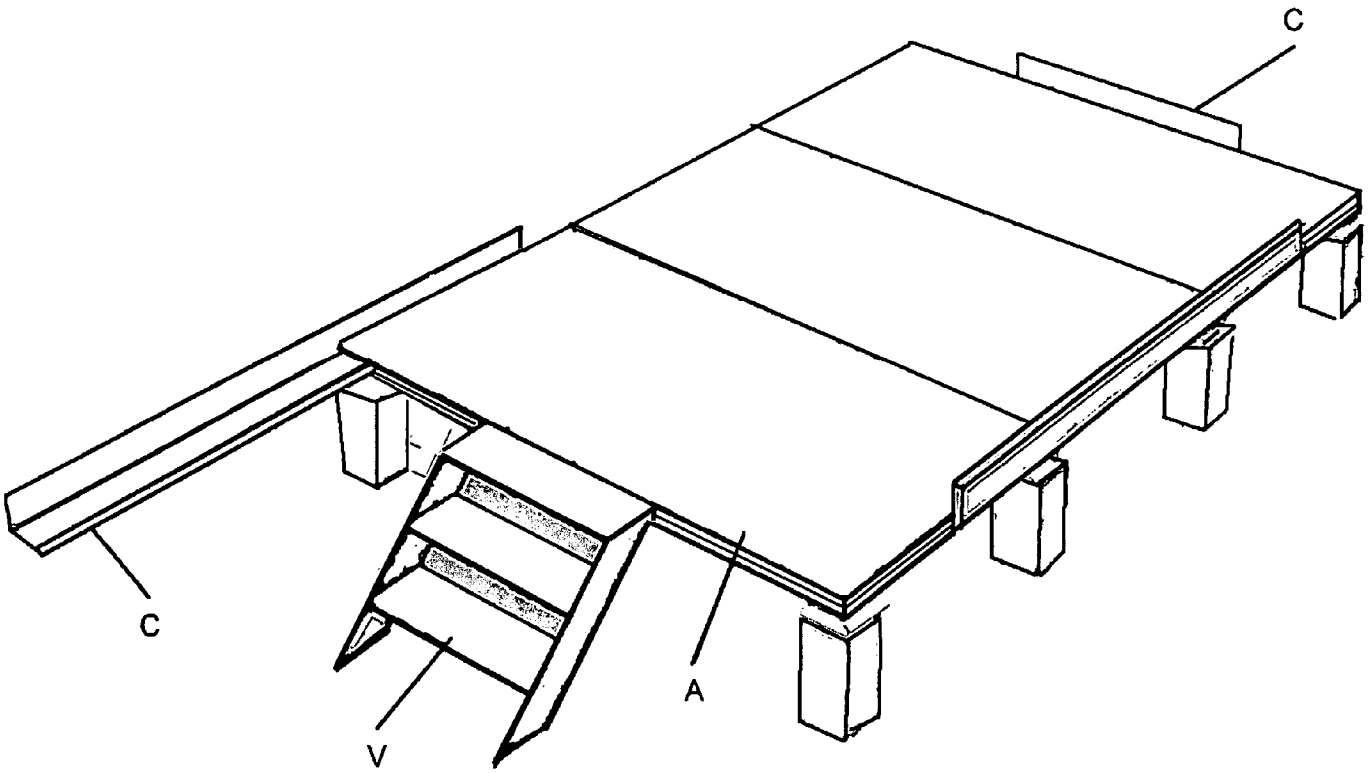
FIG. 24 is a perspective view of a partly assembled shelter, with Floor panel assemble and 90° male connector.

FIG. 24 is a perspective view of a partly assembled Small Shelter A. floor panel, C. 90° male connector, (connects floor panel to wall panel) V. Three Step Stair.

Figure 25:
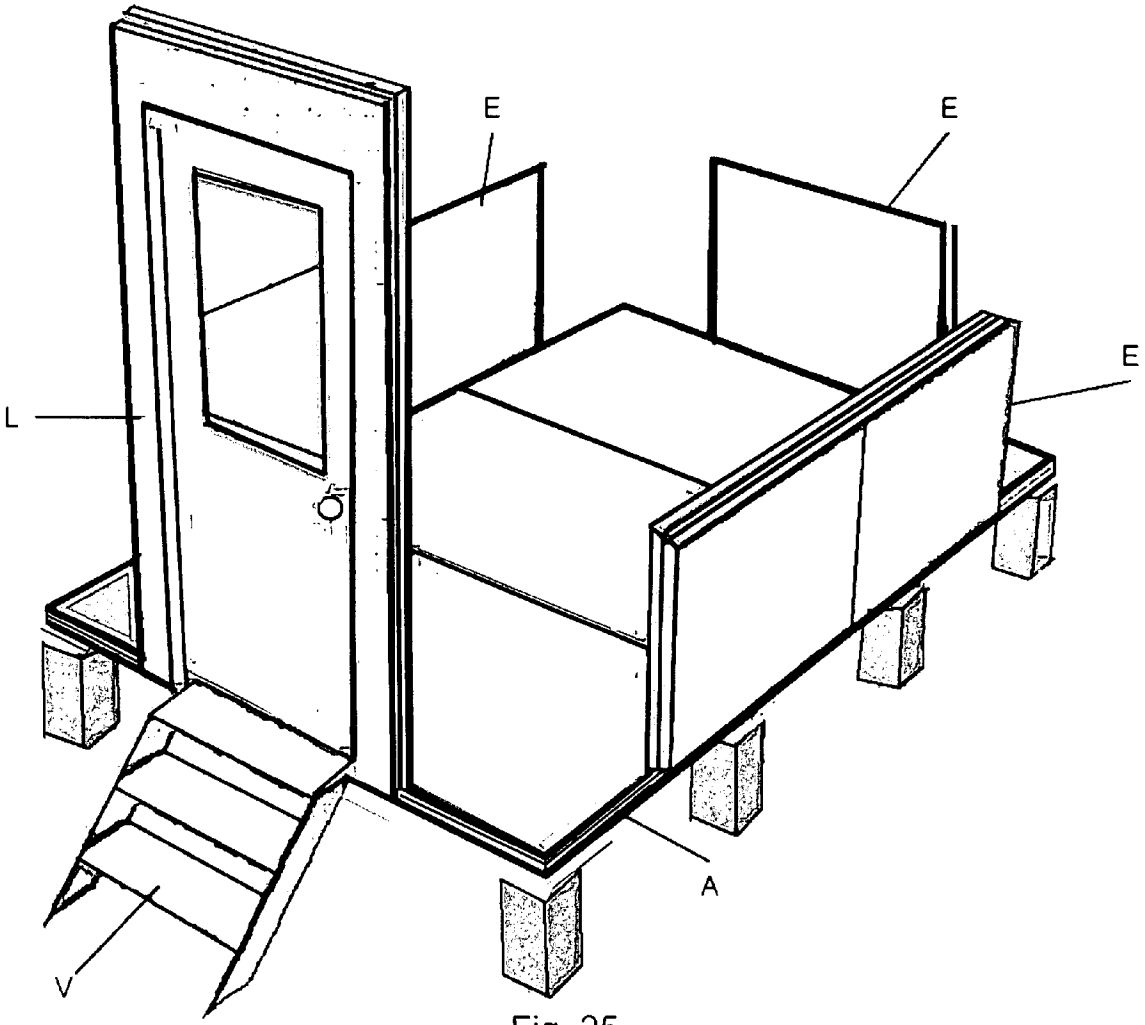
FIG. 25 is a perspective view of a partly assembled shelter, with lower wall panels and door panel.

FIG. 25 is a perspective view of a partly assembled shelter, A. Floor panels, E. Lower wall panels, L. Door panel, and V. stairs, according to the embodiment of the present invention.

Figure 26:
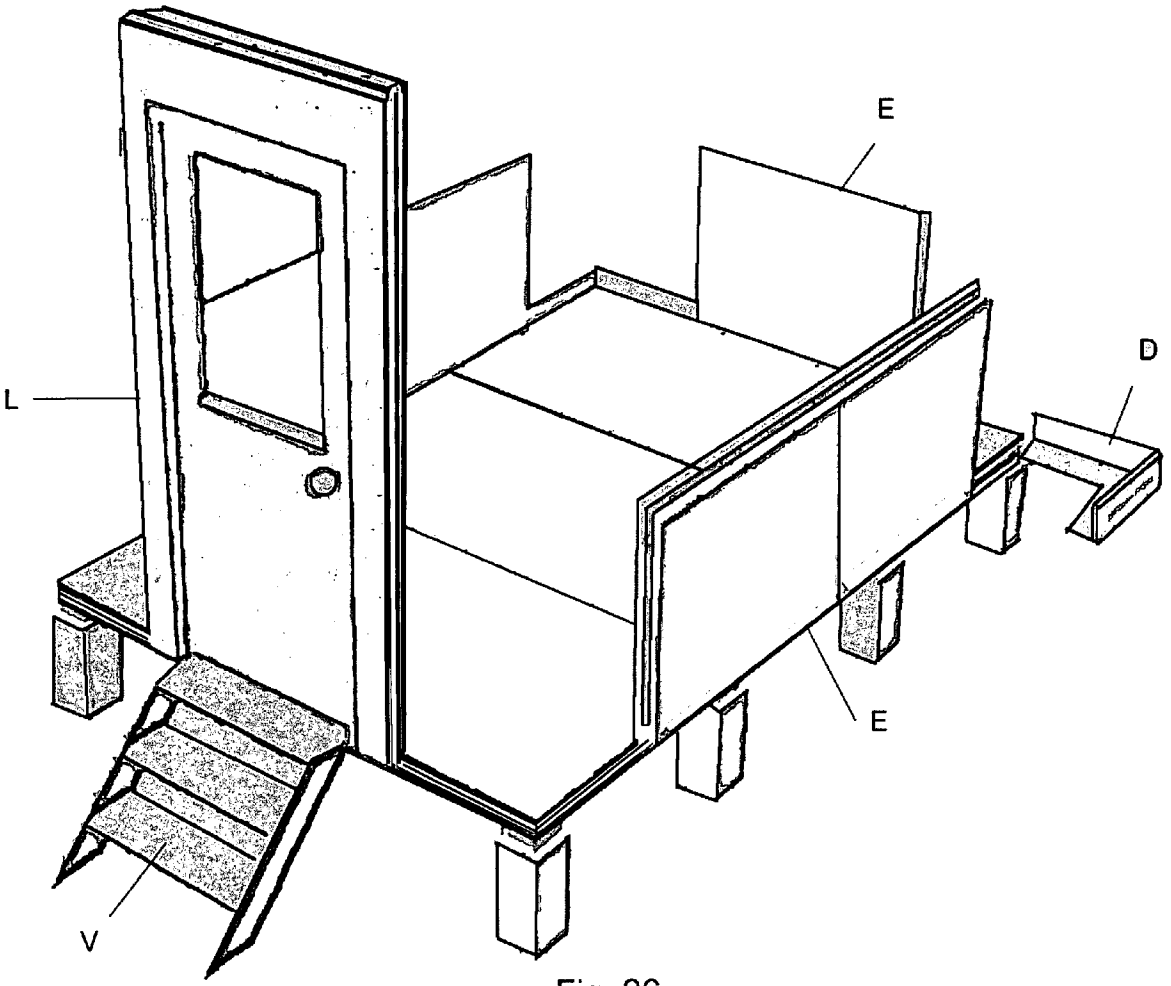
FIG. 26 is a prospective view of a partly assembled shelter, with a Floor panel Assembly and 90° corner male connector (floor to wall)

FIG. 26 is a prospective view of a partly assembled shelter, a Floor panel Assembly, E. Lower wall panels, L. Door panel, D. 90° corner male connector (wall-floor) that corresponds to the female slot on a lower corner wall panel. Note this D. 90° corner male connector (wall-floor) will not have mechanical retention on all edges. This allows assembly and disassembly. Option is to use C. two 90° male connectors.

Figure 27:
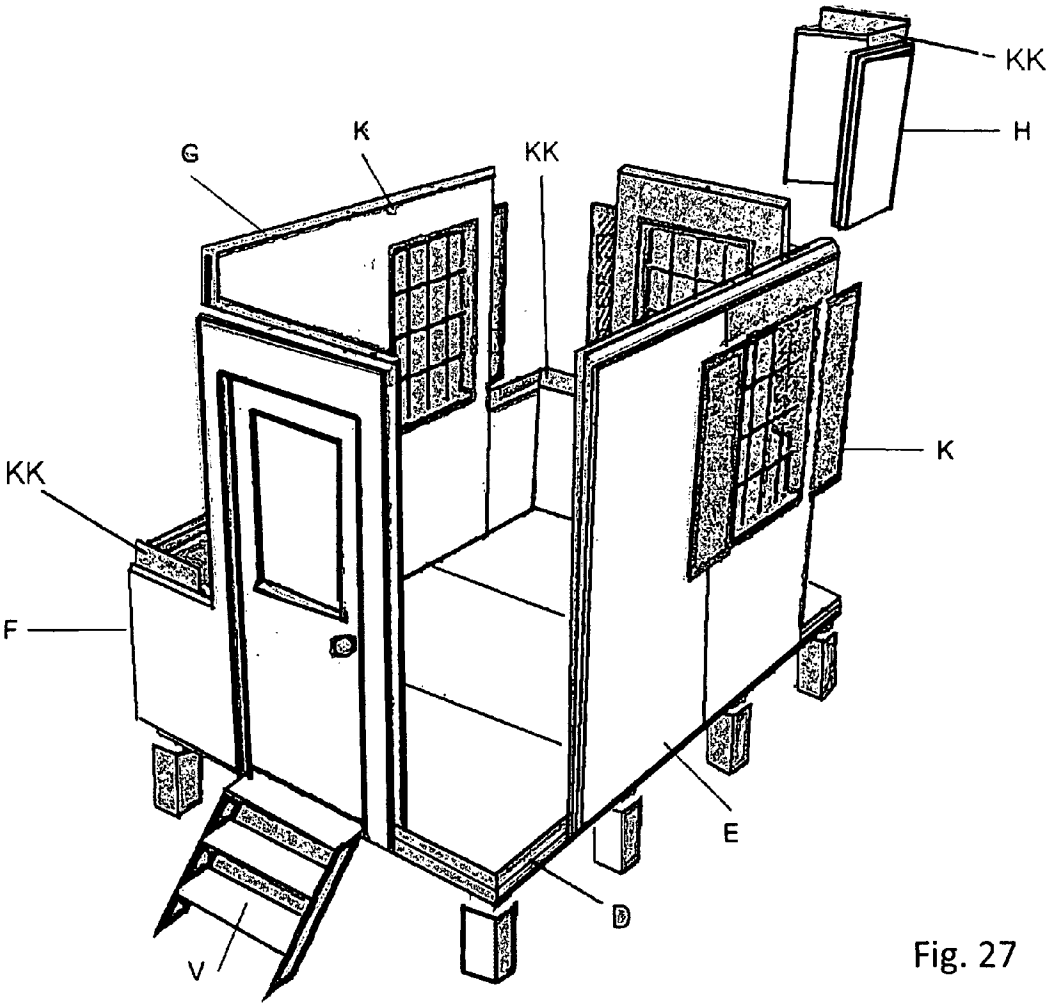
FIG. 27 is a perspective view of a partly assembled shelter, with a Floor panel assembly, door panel, upper window panels/shutters, lower and upper outside corner panels.

FIG. 27 is a perspective view of a partly assembled shelter, a Floor panel assembly, G. Upper & E Lower wall panels, K. Upper window panels. F. Lower outside corner panel and a H. upper outside corner panel with female slots that correspond to FIG. 26 D. 90° beam male corner connector, KK. corner-section male connector.

Figure 28:
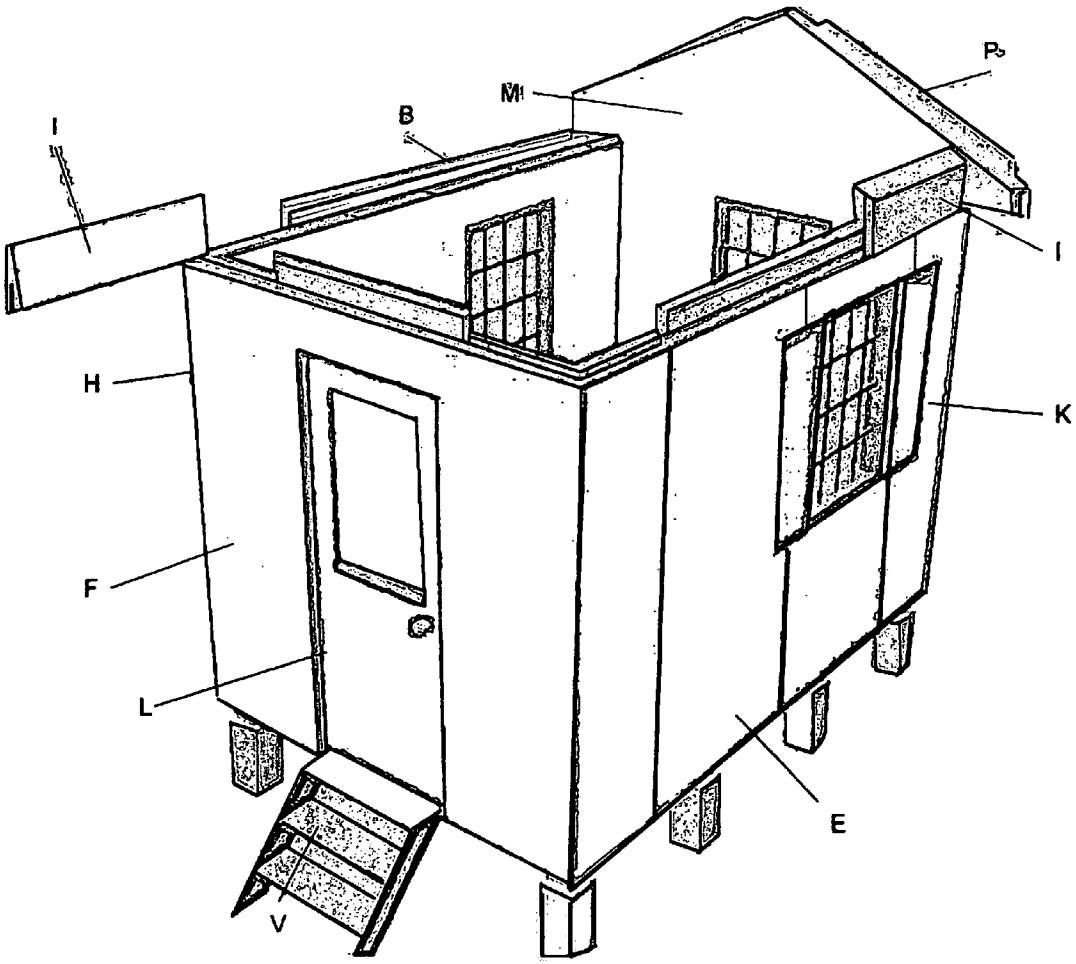
FIG. 28 is a perspective view of a partly assembled shelter, shows Truss panel (end right) and Air block wall panel (closes seam/joint/gap between top of wall and roof panel).

FIG. 28 is a perspective view of partly assembled shelter, shows M. Truss panel (end right), I. Air block wall panel (closes seam/joint/gap between top of wall and roof panel), F. Lower outside wall corner panels, H. Upper outside wall corner panels, K. Upper window panel, and L. Door panels. Panels have female slots that correspond to: B. or J. I-beam male connector, P. male T connector, C. 90° male connector, KK. 90° corner-section male connector and D. 90° corner male connector.

Figure 29:
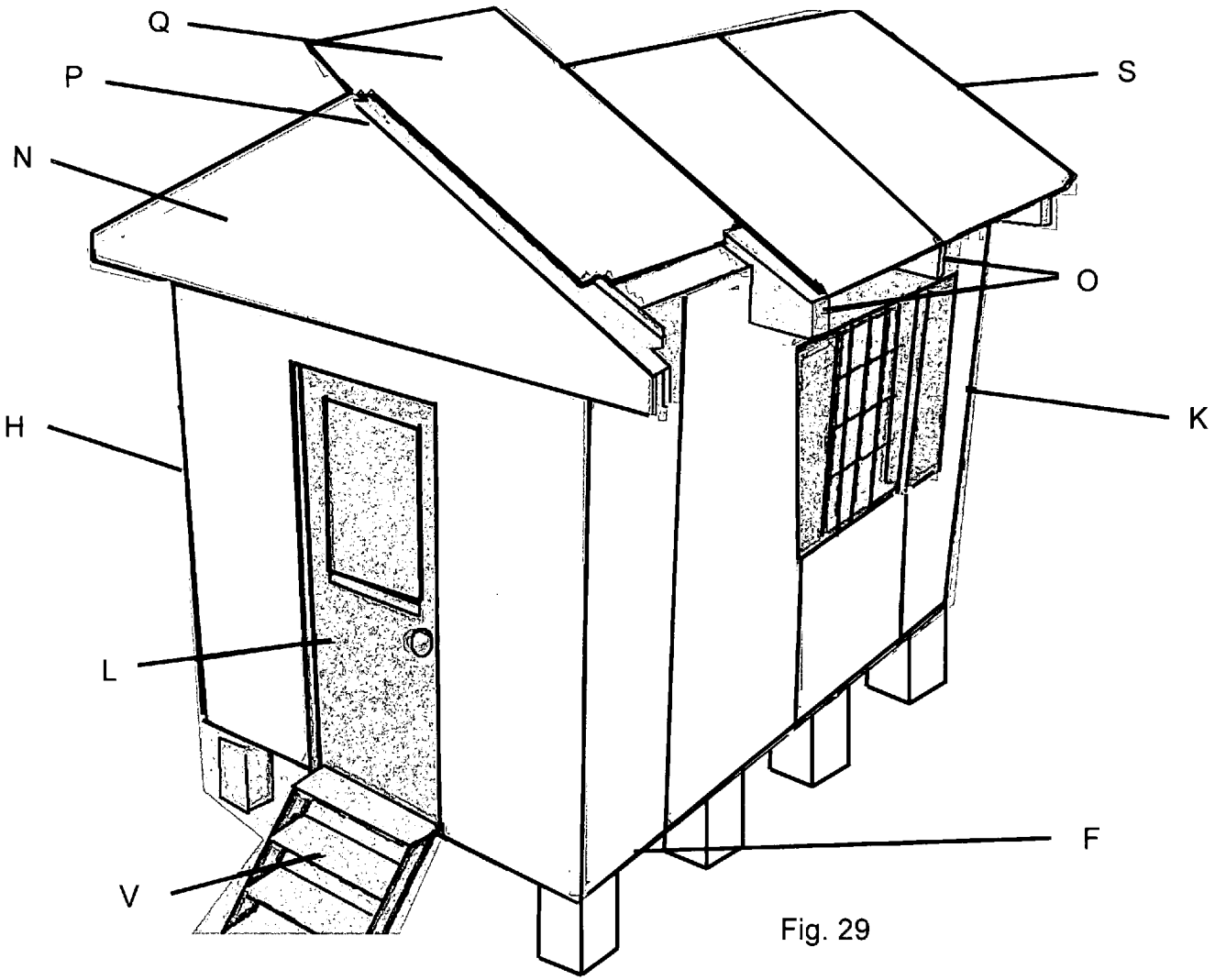
FIG. 29 is prospective view of a partly assembled Small Shelter with truss panels and roof panels.

FIG. 29 is prospective view of a partly assembled shelter, N. Truss panels (end lift) S. End roof panel, O. Truss panels (mid lift/right), Q. standard roof panel, H. Upper outer corner wall panel, F. Lower outer corner wall panels, L. Door panel, K. Upper window wall panel, V. Stairs. These panels have female slot that correspond and connects to B. or J. I-beam male connector, P. male T-connector, C. 90° beam male connector and D. 90° male corner connector.

FIG. 30/B is a prospective profile view of I-beam male connector, configured of CC. body, BB. Mechanical retention, FF. Finger hole for ease of retraction and disassembly. FIG. 30/B I-beam male connector is configured to attach panels together by joining with their corresponding female slots according to the embodiment of the present invention. Furthermore a configured hinged can be provided in the I-beam male connector. The hinged I-beam male connector is adapted to form an opening door or an opening window in the shelter. The I-beam male connector 30/B may be configures to be partially or fully hinged to form a door jam/hinge assembly. Similarly, a smaller hinged connector may be configure to be used for form a window in the wall member (not shown)

Figures 31, 32, 33, 34, 35:
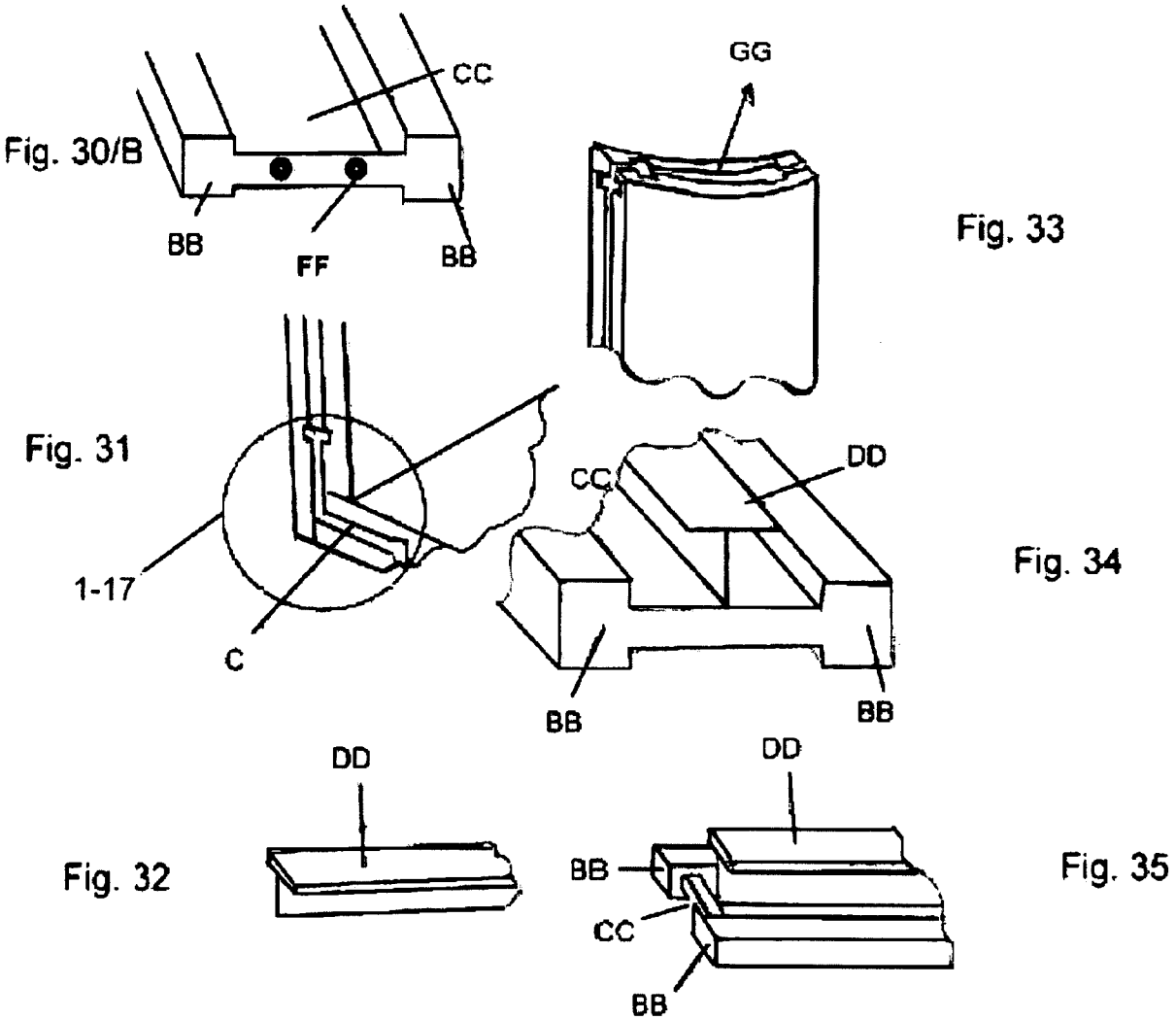
FIG. 31 is a prospective cross-section of a wall and floor panel connected by 90° male connector.
FIG. 32 is a prospective side view small male T-connector/reusable weather strip/rain-guard, end cap for panel.
FIG. 33 is a prospective anterior view of a curved panel.
FIG. 34 is a prospective profile view of a modified I-beam Male connector with rain-guard.
FIG. 35 is a prospective side view of a modified I-beam Male connector with rain-guard.

FIG. 31 is a prospective cross-section of a wall and floor panel connected by C. 90° male connector. The panels shown panel here are adapted/configured to close the gap by, lengthening or shortened their exterior or inter sides see 1-17 in contrast to FIG. 42 1-13. All panels of the present invention are adapted/configured to close the gap by, lengthening or shortened their exterior at female slot or interior at the female slot. Panels in line will have interior portion on the interior side of the female slot shortened to accommodate the width the connection member leaving the exterior portion filled with no gap.

FIG. 32 prospective side-view a small male T-connector, it can be used to fill open seams/joints/gaps between panels, used as a rain-guard and or reusable weather strip, end cap for a panel. According to the embodiment of the present invention. The vertical body may be tapered for ease of insertion. Not shown FIG. 33 is a prospective anterior view of a curved panel with GG. Female slot, that corresponds to semi-flexible and or curved male connectors. These curved panels are configured to create a round or dome shaped shelter.

FIG. 34 is a prospective profile view of modified I-beam Male connector with rain-guard/DD which is a small male T-connector. The modified I-beam male connector with small male T-connector can be used to connect panels, as a rain-guard and to fill in gaps.

FIG. 35 is a prospective side view modified I-beam male connector with small male T-connector. This configuration/adaptation is used to connect panels, to be a rain-guard and to fill open seams/joint/gaps between panels. According to the embodiment of the present invention.

FIG. 36 is a prospective cross-section/profile/junction view; it shows the junction between three panels held together with a male T-connector. Many configurations/scenarios following can be created: a roof, multiple floors, an internal wall/partition and or support for a countertop, island/table, shelf and so on. The roof scenario, E. & G. panel supported by the vertical part of the male T-connector is a Truss panel, while both lower A. panels are supported by the I-beam male connector/the horizontal part of the male T-connector are roof panels. For the first internal wall scenario, E. & G. panel is supported by the vertical part of the male T-connector is internal wall panel the two A. panels are supported by the I-beam/horizontal part of the male T-connector and are floor panels. In the second interior walls scenario, E. & G. panel supported by the vertical part of the male T-connector is interior wall, both A. panels are external walls and are supported by the horizontal part of the male T-connector. In the second or multiple floors scenario, the (vertical) aligned portions of the of the male T-connector will support the upper and lower walls in-line, of the two story application and the (horizontal) portion of the T-male connector will support the floor/ceiling of the two story shelter.

In the countertop scenario as seen in E. & G. panel supported by the vertical part is a countertop panel; both A. panels are outside wall panel and are supported by the horizontal part of the male T-connector roof panel or external walls panels. The pedestal scenario, E. & G. panel supported by the vertical part of the male T-connector is a pedestal panel; both A. panels supported by a I-beam/horizontal part of T beam male connector are floor panels.

This male T-connector is modify with a diminishing body seen EE-1. This diminishing body I allows for a narrowed open seam/joint/gap.

FIG. 37 is a prospective profile view of a small male T-connector. Used to close seams/joints between panels, end cap for panel. The small male T-connector may have a tapered and for ease of insertion.

FIG. 38 is a prospected view of a panel HH. Flanges. The configuration of overlapping flanges may work as a rain-guard JJ. is a configuration of a infrared heating and or cooling cell.

FIG. 39/P is a prospective view of a male T-connector and a cross-sectional/profile/view of a junction between three panels. 39/P is used for the same purposes of as FIG. 36. Referred to FIG. 36 for description.

FIG. 39/F is a perspective view of a piece of furniture/kitchen Island/tabletop, 1. Island/tabletop panel 2. male T-connector 3. Pedestal 4. Floor panels/base.

Yet another scenario for FIGS. 36 & 39/P is support for couch chair bench stool. In this scenario E. & G. panel supported by the vertical part of the connector is the back panel of the selected furniture, both A. are floor panels they are supported by the horizontal part/I-beam part of male T-connector.

Anchoring the furniture into the floor by means of a male T connector is one scenario. The other scenario is to build the furniture free standing, out of panels with female slots that corresponding male connectors.

Figure 40:
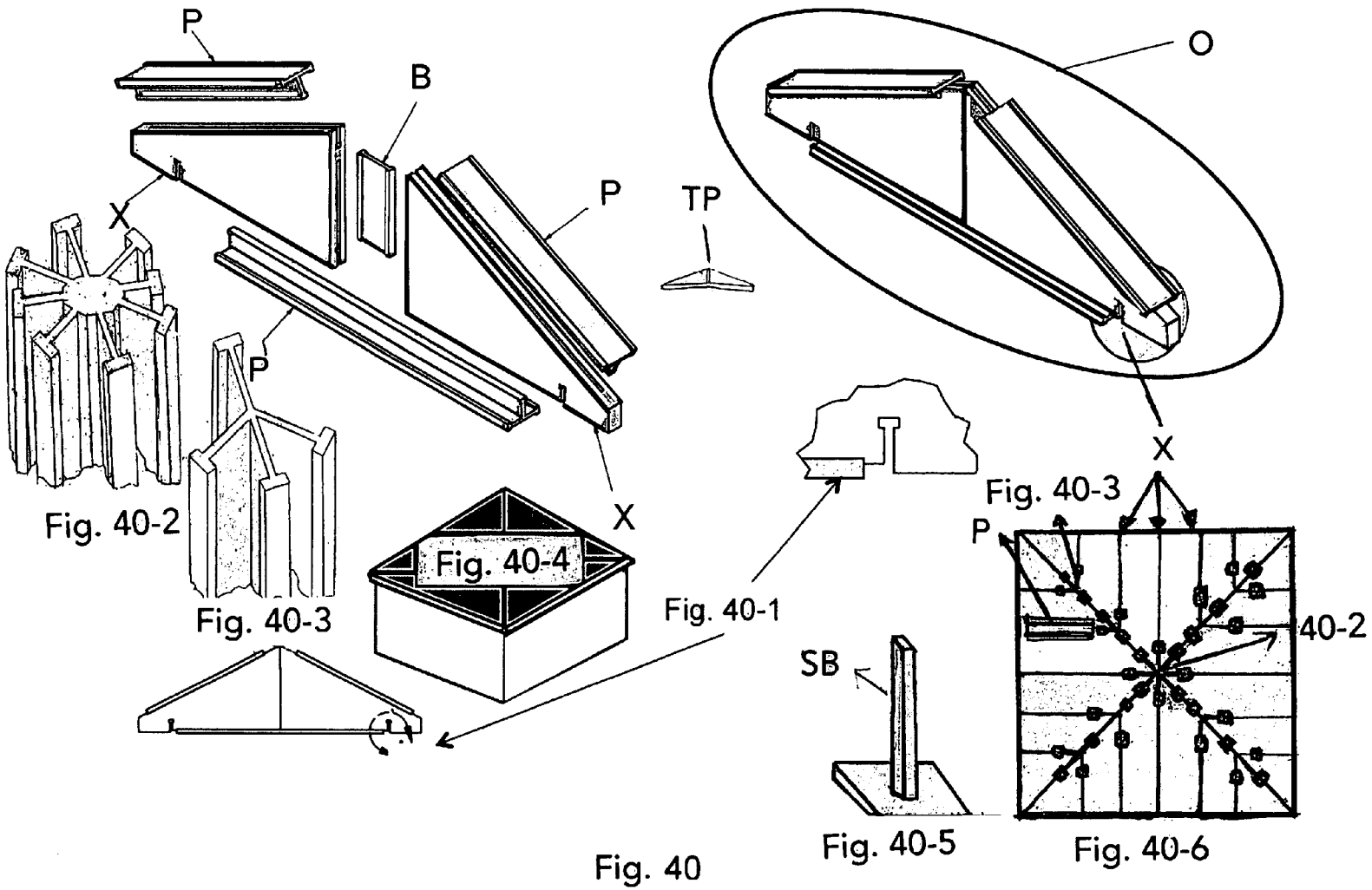
FIG. 40 is a perspective view of a truss panel assembly (Med left and right).

FIG. 40 is a perspective view, O. Truss panel (mid-Left/Right); X. Truss panel sections have female slots that correspond to B. I-beam male connector and P.T beam male connectors. FIG. 40-1 is it cross-sectional view of the truss panel connecting to the wall panel. In case of a square hip roof FIG. 40-4. Shown is a configuration of I beam male connectors FIG. 40-2 Center connector and FIG. 40-3 Junction Connector are used to join the trust sections together. SB is a support pole that receive FIG. 40-2 the Center Connector. TP is a top for the apex of the roof.

Figure 41:
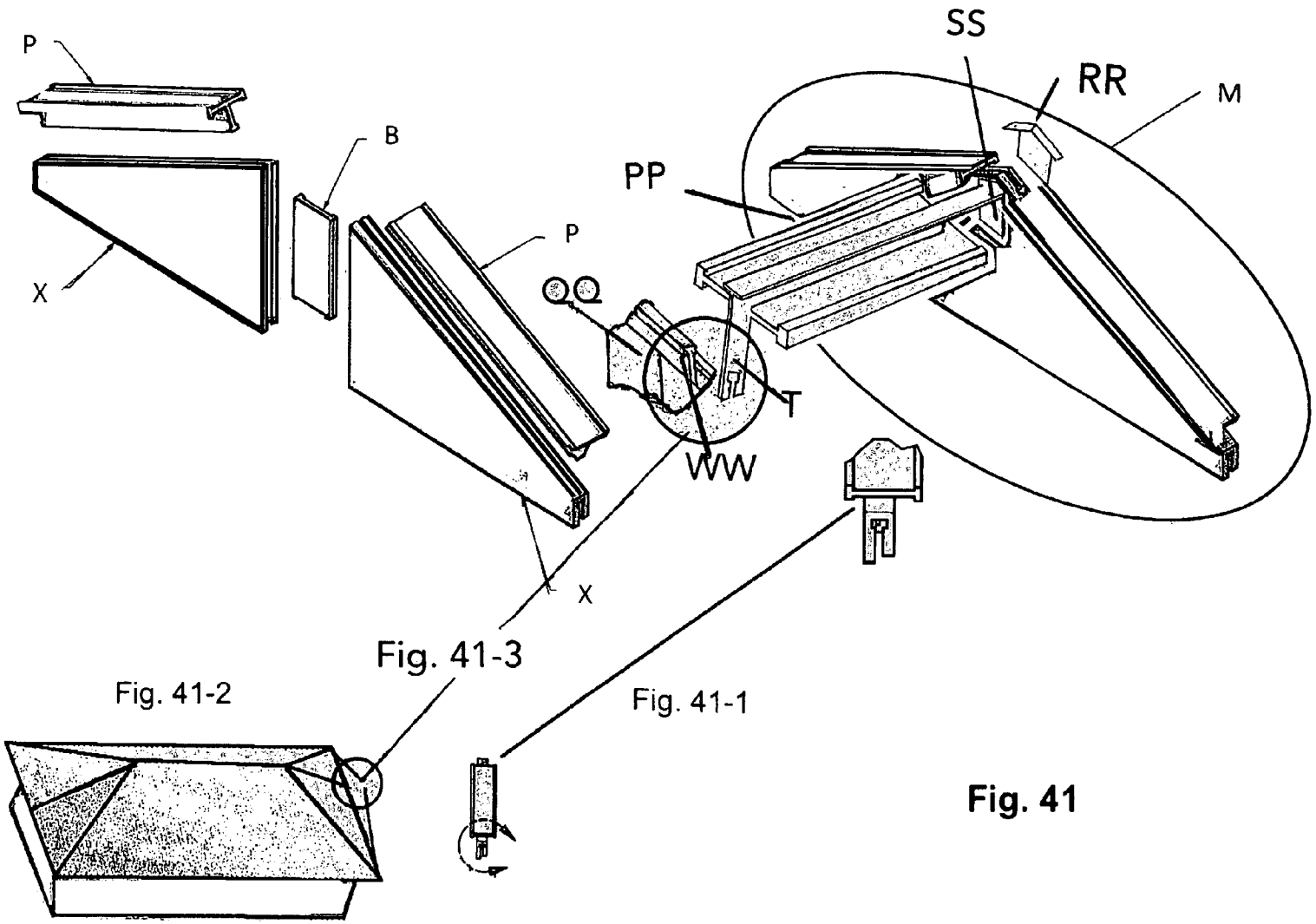
FIG. 41 is a prospective view of a truss panel assembly (End-right).

FIG. 41 is a prospective view of M. Truss panel (end/right); X. Truss sections have female slots that correspond to B. I-beam male connector and P.T beam male connectors. FIG. 41-1 is a cross-sectional view of trace panel connecting to the wall panel. In case of a hip roof FIG. 41-2. FIG. 41-3 shows configuration of a cross-section of a trust assembly, PP a I-beam with rain guard configuration with two legs. The first leg T contains a female slot that corresponds to the QQ I-beam male connector in turn connects to the WW wall panel, the second leg SS is a male connector, which corresponds to the female slot of the truss. The angle configuration of these legs will be determined by pitch for the roof. RR is a space filler and rain guard.

FIG. 42 is a configuration of both a prospective view the Water Line Assembly and also an exploded view, A. Floor panel and E. Lower wall panel, 1-1 a waterline that is easily accessible, It can be house behind either a 1-2 clip on Y. baseboard shown, and or behind a 1-2 clip on FIG. 43 Z Chair-rail not show. 1-3 coupling used to join multiple waterlines. The shelter assembly can also have one or more exterior holes with plugs to accommodate utilities in the walls and floors. Utilities shall include but are not limited to water, sewer, power, cable, and telephone lines.

FIG. 42 1-13 is it junction between E. Lower wall panel and A. floor panel. C. 90° beam male connector is used to join the panels together. Y. Baseboard is shown. In 1-13 notice the gap between the wall panel and floor panel. This gap can be closed by using the modified panels with longer outer sides as shown in FIG. 31 1-17.

FIG. 43 is a configuration of both prospective view of the Electrical Line Assembly and exploded view. Shown A. Floor panel and G. Upper wall panel, 1-4 Conduit & wire is easily accessible. It can be house behind either a 1-2 clip on Z. chair-rail shown and or behind a 1-2 clip on FIG. 42 Y. baseboard not shown. The shelter assembly can also have one or more exterior holes with plugs to accommodate utilities in the walls and floors.

Figure 44:
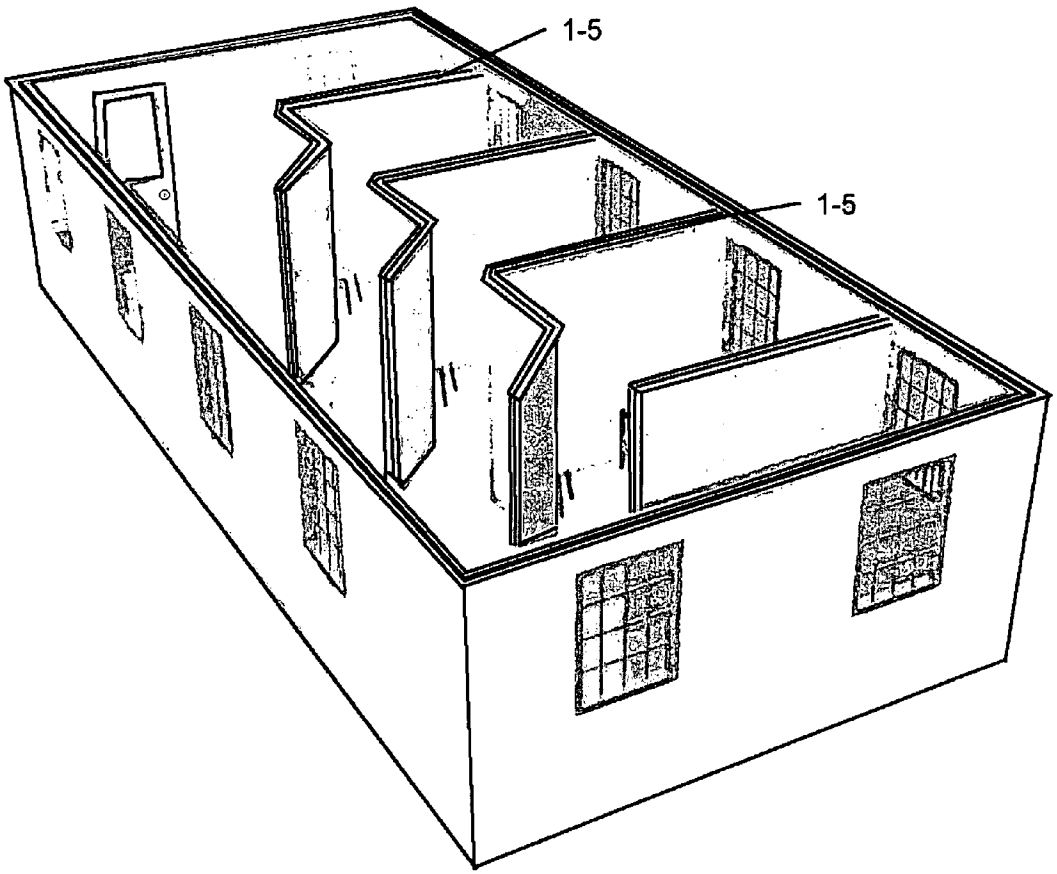
FIG. 44 is a perspective view of interior walls/partition.

FIG. 44 is a configuration of a perspective view of internal walls/partitions. They are created by plurality of internal wall panels with corresponding I-beam, 90°, T male connectors, and internal wall/door panel.

Figure 45:
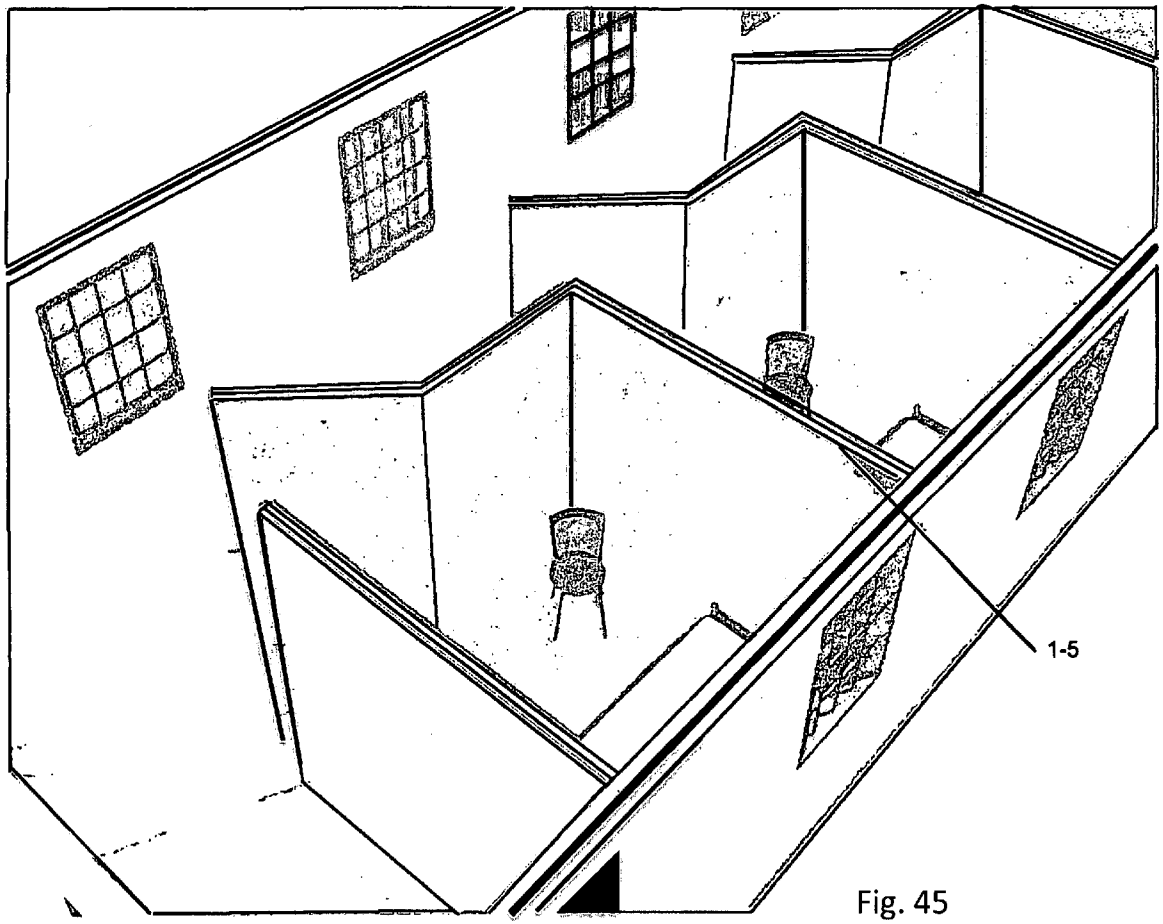
FIG. 45 is a yet another perspective view of interior walls/partition.

FIG. 45 is yet another configuration of a perspective view of internal walls/partitions. They are configure from plurality of internal wall panels, corresponding I-beam, 90°, T male connectors, and internal wall/door panel.

Figure 46:
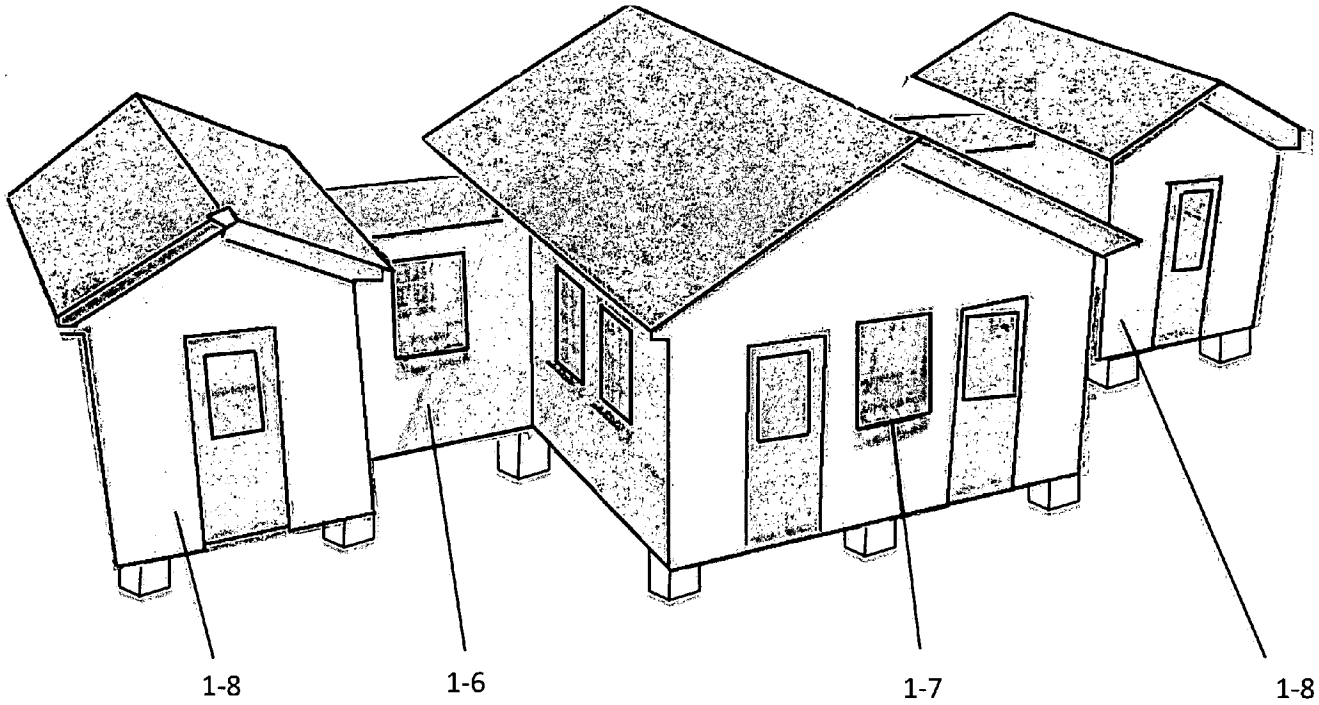
FIG. 46 is a prospective view of a Large Shelter.

FIG. 46 is a prospective view of a large shelter. It is configured by plurality of 1-8 smaller shelters connected together with 1-6 breezeway/hallway. 1-7 flowerbox is shown.

Figure 47:
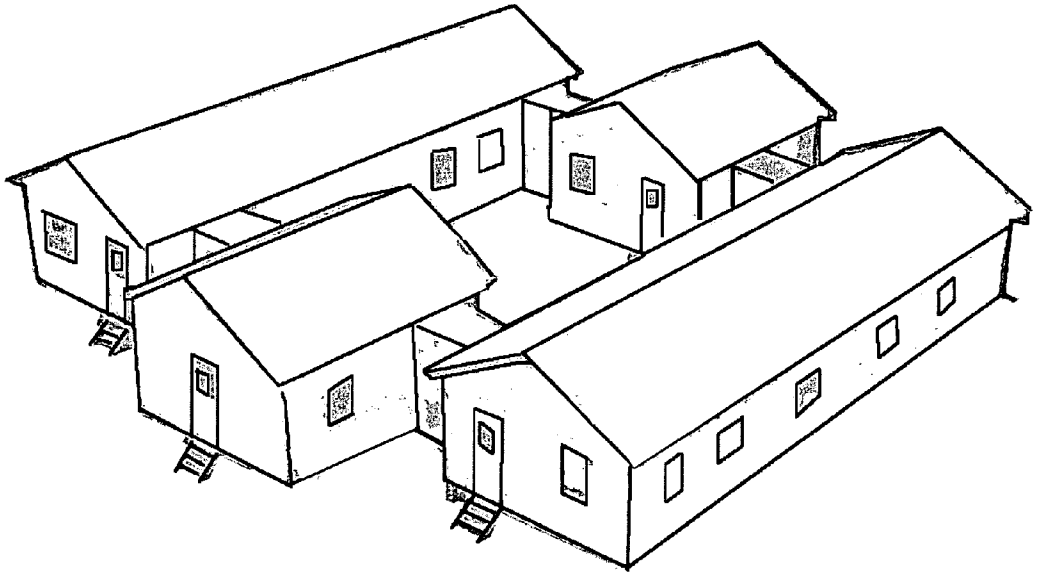
FIG. 47 is a perspective view of building with courtyard.

FIG. 47 is a prospective view court-yard. It is configured by plurality of large shelters connected together with breezeway/hallways.

FIG. 48 is a configuration of a prospective back view of a Large Shelter showing a configuration of a water collection assembly, U. Rain gutter and W. Cistern. The cistern is constructed from the panels and male connectors, with a plastic lining.

FIG. 49 is yet another configuration of a prospective side view of a Large Shelter with a configuration of a water collection assembly. Shown U. Rain gutter and W. Cistern.

FIG. 50 is a prospective view of a small shelter with configuration of a 1-10 solar panel.

FIG. 51 is a configuration of a prospective view of a 1-11 container with 1-12 Wheels may have a configuration of a hitch and two handles to aid in transportation. A shipping container is a configuration of the same components: members/panels with female slot with the corresponding male connector/fitting. These components will be taken apart and used part of the shelter. In this shipping container one will find all the components and parts needed to build the emergency shelter and all the provisions one would need an emergency situation and sustainable living. Provisions and shelter will be configure/modified for different Geographic location. Supplies in the emergency kit may include Aquaponics and or other means of self-sustaining food. Supplied in the emergency kit one may find (medicine, medical supplies, first aid Sep. 16, 2013) supplies a compost commode, sink, basic furniture, cabinets, clothing, food rations, water purification system, provisions needed to sustain life based in different regions of the world etc.

Furthermore the components, the panel with female slot with corresponding male connectors configured to be used in other capacities, i.e. the shelter as mentioned, remote offices and homes, camping, summer homes, low-cost housing, a sleeping capsule, cistern, composting Storage shed, cubicles, for conventions, temporary flooring, decks, fencing, furniture, cabinetry, create a countertop cabinet, island, table, furniture, etc.

It should be understood, of course, that the foregoing relates to exemplary embodiments of the invention and that modifications may be made without departing from the spirit and scope of the invention as set forth in the following claims.

What is claimed is:

1. A shelter assembly comprising:

a roof formed of one or more of truss sections and roof members, the truss sections adapted to connect to each other with slots and corresponding I-beam male connectors forming a truss member, said truss members adapted to connect with female slots and corresponding male T-connectors to roof members and wall members;

a wall formed of wall sections adapted to connect to each other with slots and corresponding I-beam male connectors forming a wall member, the wall members adapted to connect to each other with female slots and corresponding I-beam male connectors;

an outside corner formed of one or more corner sections adapted to connect to each other with corresponding female slots that correspond to 90° corner section male connectors forming an outside corner wall member, the outside corner wall members adapted to connect with female slots and corresponding 90° corner male wall-floor connectors to floor members;

a floor comprising one or more floor members adapted to connect to each other with slots and corresponding I-beam male connectors, the floor member is adapted to connect to a wall member with female slots and corresponding 90° male connectors;

an internal wall or partition comprising one or more internal wall or partition wall members adapted to connect to each other with slot and corresponding I-beam male connectors, one or more male T-connectors are used for connection between internal walls, exterior walls and the floor.

2. The shelter assembly of claim 1, further comprising a small male T-connector wherein said small male T-connector is used to connect panels, as a rain-guard and a weather strip end cap to fill in seams, joints, and gaps.

3. The shelter assembly of claim 1, further comprising a modified male I-beam connector with rain-guard wherein said modified I-beam male connector with rain guard is used to connect panels providing a rain-guard and a weather strip end cap to fill in seams, joints, and gaps.

4. The shelter assembly of claim 1, wherein said male connectors further comprise a diminishing and expanding body that creates a profile, giving the connector mechanical retention while engaged with corresponding female slot members.

5. The shelter assembly of claim 1, wherein said male connectors are semi-flexible or curved to accommodate rounded shaped panel members, wherein curved panel members with female slots corresponds to said semi-flexible or curved male connectors to create a circular or done shape shelter.

6. The shelter assembly of claim 1, wherein said male connectors have angles to accommodate the various shapes of the shelter.

7. The shelter assembly of claim 1, wherein said male connectors have a configuration of finger holes for ease of retraction and disassembly.

8. The shelter assembly of claim 1, wherein said shelter is configured in one of a square, rectangle, round, dome or octagonal shape.

9. The shelter assembly of claim 1, wherein multiple shelters are connected by breezeways or hallways.

10. The shelter assembly of claim 1, wherein said one or more floor members are disposed away from a surface by a plurality of adjustable feet or a concrete riser connected to the floor members having a release mechanism to release the shelter from the riser, enabling the shelter to be dismantled, or a riser comprised of a heavy coiled spring allowing the shelter to move with the earth.

11. The shelter assembly of claim 1, wherein said at least one or more floor members includes a built-in level for leveling the shelter.

12. The shelter assembly of claim 1, further comprising one or more exterior holes with plugs to accommodate utilities in the walls and floors.

13. The shelter assembly of claim 1 further comprising a floor member comprising one or more of a low shower basin, or floor panels sloped to allow water to drain.

14. The shelter assembly of claim 1 further comprising a wall member comprising one or more door panels and one or more windows;

wherein said door and window panels are formed in the wall member; or wherein a hinged I-beam connector is adapted to form an opening door or an opening window in the shelter.

15. A shelter assembly of claim 1 further comprising a wall member and connector, having one or more means to connect, hooks or other mechanisms for attaching different items to include but are not limited to furniture and countertops.

16. The shelter assembly of claim 1 further comprising a roof member with one or more skylights or exhaust fans; and wherein the truss members are configured to form a hip roof.

17. The shelter assembly of claim 1 further comprising a water line and an electrical assembly housed behind baseboards, chair-rail or a combination thereof.

18. The shelter assembly of claim one further comprising an infrared heating assembly housed in a wall member.

19. The shelter assembly of claim one further comprising a water collection assembly with gutter and cistern.

20. A shelter kit comprising:

the shelter assembly of claim 1; and a container made of components of the shelter assembly for shipping;

one or more ladders for assembling a shelter;

one or more augers for digging holes for a foundation;

wherein the container is adapted for use as at least one of a water cistern, a compost container, or panels and corresponding male fittings are used for parts to build the shelter;

further comprising stairs, basic living accessories, and emergency provisions;

wherein the living accessories including at least one of a bed, a table, a chair, a commode, a shower, a sink, food or medical supplies, a kitchen counter, cabinets, and an island made from the same components, to include the panels and connectors;

further comprising a sleeping capsule made of shelter components to provide temporary shelter while the shelter assembly is being assembled and to provide additional panels and connectors.

* * * * *